US008891981B2

(12) United States Patent
Matsumoto et al.

(10) Patent No.: US 8,891,981 B2
(45) Date of Patent: Nov. 18, 2014

(54) IMAGE FORMING APPARATUS CAPABLE OF CORRECTING IMAGE INFORMATION

(75) Inventors: Tae Matsumoto, Yokohama (JP); Tomoyuki Saiki, Suntou-gun (JP); Takayuki Fukutani, Meridian, ID (US); Yuuji Takayama, Suntou-gun (JP); Yuichi Ogawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 882 days.

(21) Appl. No.: 13/075,584

(22) Filed: Mar. 30, 2011

(65) Prior Publication Data

US 2011/0243582 A1 Oct. 6, 2011

(30) Foreign Application Priority Data

Mar. 31, 2010 (JP) ..... 2010-082808

(51) Int. Cl.
*G03G 15/00* (2006.01)
*G03G 15/01* (2006.01)

(52) U.S. Cl.
CPC ..... *G03G 15/0131* (2013.01); *G03G 15/5058* (2013.01); *G03G 2215/00059* (2013.01); *G03G 2215/0164* (2013.01); *G03G 2215/00063* (2013.01); *G03G 2215/0129* (2013.01)
USPC ..... 399/15; 399/49

(58) Field of Classification Search
CPC ..... G03G 2215/00029
USPC ..... 399/15, 38, 44, 49
See application file for complete search history.

(56) References Cited

U.S. PATENT DOCUMENTS

| | | | | |
|---|---|---|---|---|
| 7,072,597 | B2 * | 7/2006 | Shimura et al. | 399/49 |
| 7,382,387 | B2 * | 6/2008 | Ichikawa et al. | 399/49 X |
| 7,680,425 | B2 * | 3/2010 | Hama et al. | 399/49 |
| 8,213,816 | B2 * | 7/2012 | Kozitsky et al. | 399/15 X |

FOREIGN PATENT DOCUMENTS

| | | | |
|---|---|---|---|
| JP | 2004-317538 | A | 11/2004 |
| JP | 2006-343680 | A | 12/2006 |
| JP | 2007-108246 | A | 4/2007 |
| JP | 2009-154331 | A | 7/2009 |

* cited by examiner

*Primary Examiner* — Sandra Brase
(74) *Attorney, Agent, or Firm* — Canon U.S.A., Inc. IP Division

(57) ABSTRACT

An image forming apparatus executes banding correction at a level determined according to variation of the density characteristic of the image forming apparatus to achieve a high quality image. In the image forming apparatus, a banding correction unit acquires information about a cause of density variation that may occur in a sub scanning direction of a rotation member, which is used for forming a toner image on an image carrier based on input image information and sets, based on the acquired information, the level of the density correction, which is determined according to the density variation cause information.

13 Claims, 21 Drawing Sheets

| DOT REPRODUCTIVITY INFORMATION | GAMMA-CORRECTION TABLE |
|---|---|
| STATE 1 (NEW CRG) |   |
| STATE 2 (OLD CRG) |   |

FIG.20

| DOT REPRODUCTIVITY INFORMATION | DENSITY |
|---|---|
| STATE 1 | d1 |
| STATE 2 | d2 |
| STATE 3 | d3 |

IMAGE FORMING APPARATUS CAPABLE OF CORRECTING IMAGE INFORMATION

BACKGROUND OF THE INVENTION

1. Field of the Invention

The present invention relates to an image quality stabilization method executed on an image forming apparatus.

2. Description of the Related Art

Recently, an electrophotographic type image forming apparatus and an inkjet type image forming apparatus have been used. It is desired that such an image forming apparatus is capable of forming an image having a higher quality than a certain level. As one of causes of degradation of image quality, density unevenness (i.e., banding) in a sheet conveyance direction (sub scanning direction) may occur.

Under such circumstances, Japanese Patent Application Laid-Open No. 2007-108246 discusses a method for solving the problem of banding that may occur in the sub scanning direction. More specifically, the method discussed in Japanese Patent Application Laid-Open No. 2007-108246 previously measures banding that may occur in the sub scanning direction with a period due to an outer diameter of a photosensitive drum in association with a phase of the photosensitive drum. Furthermore, the conventional method stores a result of the measurement on a storage unit as a density pattern information table. In addition, during image forming, the conventional method reads information about the banding according to the phase of the photosensitive drum from the table. In addition, the conventional method corrects the banding occurring with the period due to the outer diameter of the photosensitive drum.

Japanese Patent Application Laid-Open No. 2007-108246 also discusses a method, which is similar to the above-described method, for correcting banding that may occur with a period due to an outer diameter of a development roller.

On the other hand, the degree of scatter of toner and the stability of minute dots (hereinafter collectively referred to as a "density stability" or a "dot reproductivity") may vary due to an environment variation, such as variation in the temperature or the humidity inside or outside the image forming apparatus or a state of use and an operation state of a toner cartridge (hereinafter simply referred to as a "toner CRG") or a photosensitive drum, such as the consumption or the degradation thereof.

Due to the above-described causes, even if the type of the cause of the density variation in the sub scanning direction (e.g., unevenness in the rotation speed of the photosensitive drum) is the same, the level of the banding may vary. In the following description, the cause of the density variation in the sub scanning direction may be simply referred to as a "sub scanning direction (SSD) density variation cause".

Now, an exemplary case will be specifically described in detail below with reference to FIGS. 21A and 21B. In the example illustrated in FIG. 21A, in forming a uniform-density image 606, an SSD density variation cause 607 may occur. As the SSD density variation cause 607 illustrated in FIG. 21B, unevenness of the rotation speed of a photosensitive drum is illustrated.

In a lower portion of the example illustrated in FIG. 21B, banding that may occur due to the unevenness of the rotation speed, which is the SSD density variation cause 607, is illustrated. A curve 608 corresponds to banding that may occur when a new toner CRG is utilized. A curve 609 corresponds to banding that may occur when an old toner CRG is utilized, whose dot reproductivity has been deteriorated due to consumption and degradation thereof.

As described above, even if the same SSD density variation cause has occurred, if image forming is executed under different operation conditions, the amplitude (level) of the banding that may become visible on the image may vary. In some cases, the same problem may occur due to environmental variations.

SUMMARY OF THE INVENTION

The present invention is directed to an image forming apparatus capable of achieving a high quality image by correcting banding according to the level of banding that may vary due to variation of a density characteristic of the image forming apparatus.

According to an aspect of the present invention, an image forming apparatus includes a rotation member configured to form a toner image on an image carrier based on image information, a first acquisition unit configured to acquire density variation cause information about a cause of density variation occurring in a sub scanning direction of an image, which may occur due to rotation of the rotation member, a correction unit configured to correct the image information according to the information about the cause of the density variation acquired by the first acquisition unit, and a second acquisition unit configured to acquire indirect density variation information, which indirectly indicates a level of the density variation. In the image forming apparatus, the correction unit is configured to set a level of correcting the image information corresponding to the density variation cause information based on the indirect density variation information without detecting, from the formed toner image, a level of the density variation corresponding to the density variation cause information.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to describe the principles of the invention.

FIG. 20 illustrates an example of information referred to in processing for identifying a dot reproductivity according to the second exemplary embodiment of the present invention.

DESCRIPTION OF THE EMBODIMENTS

Various exemplary embodiments, features, and aspects of the invention will be described in detail below with reference to the drawings.

However, components, units, and configurations described in each exemplary embodiment of the present invention are mere examples and the scope of the present invention is not limited to those described herein.

Figure 1A:
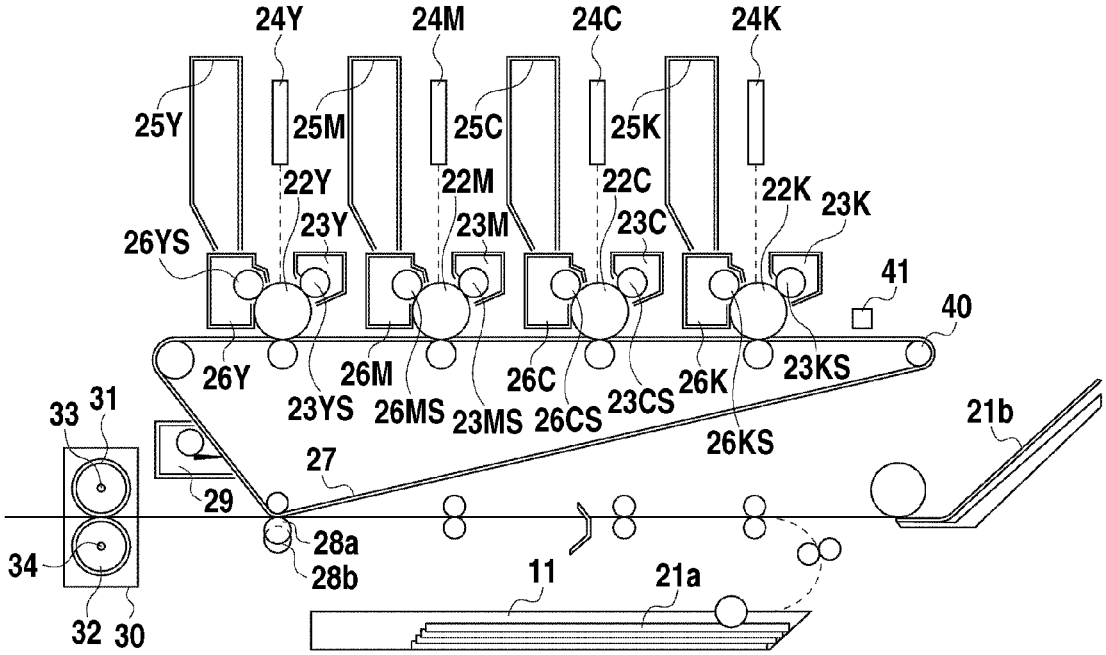
FIGS. 1A and 1B illustrate an exemplary configuration of a printing unit of an image forming apparatus.

A first exemplary embodiment of the present invention will now be described below. FIG. 1 illustrates an example of an electrophotographic type image forming apparatus according to the present exemplary embodiment. More specifically, FIG. 1 is a schematic section of a tandem type image forming apparatus that employs an intermediate transfer belt (an endless belt) 27, which is an intermediate transfer member. An exemplary embodiment of the present invention is not limited to the image forming apparatus including the intermediate transfer belt 27. To paraphrase this, an image forming apparatus that employs a method for directly transferring a toner image formed and developed on a photosensitive drum 22 onto a transfer material can implement the present invention. Now, an exemplary operation of an image forming unit included in the image forming apparatus according to the present exemplary embodiment will be described in detail below.

At first, a scanner unit 24, which is lit according to an exposure time acquired by converting input image data (an input image signal), forms an electrostatic latent image on the photosensitive member (the photosensitive drum 22). In addition, a development unit 26 develops the electrostatic latent image to form monochromatic toner images. Subsequently, the monochromatic toner images are serially transferred onto the intermediate transfer belt 27 to form multicolor toner images. Then, the multicolor toner images formed in the above-described manner are transferred onto a recording paper 11 (a recording medium). Then the multicolor toner images are fixed on the recording paper 11 by a fixing device 30.

The image forming unit includes paper feed units 21*a* and 21*b*, the photosensitive drums 22Y through 22K, injection charging devices 23Y through 23K, toner cartridges 25Y through 25K, development units 26Y through 26K, the intermediate transfer belt 27, a transfer roller 28, and the fixing unit 30. More specifically, the "photosensitive drums 22Y through 22K" is an abbreviation of the "photosensitive drums 22Y, 22M, 22C, and 22K".

The photosensitive drums 22Y, 22M, 22C, and 22K, which are image carriers, are provided to stations arranged in tandem for development colors of yellow (Y), magenta (M), cyan (C), and black (K), respectively. Each of the photosensitive drums 22Y through 22K is constituted by an aluminum cylinder on which outer periphery an organic photoconductive layer is applied. The photosensitive drums 22Y through 22K is rotated by the drive force transmitted from a drive motor 47 illustrated in FIG. 3. The drive motor 47 rotates the photosensitive drums 22Y through 22K by a drive force transmission unit, which will be described in detail below, in the counterclockwise direction as an image forming operation proceeds.

The injection charging devices 23Y, 23M, 23C, and 23K, which are primary charging devices, are provided to the stations, respectively. In addition, the injection charging devices 23Y through 23K evenly charges the surface of each of yellow (Y), magenta (M), cyan (C), and black (K) photosensitive drums 22Y through 22K. Sleeves 23YS, 23MS, 23CS, and 23KS, which are development rollers, are included in the injection charging devices 23Y through 23K, respectively.

Exposure light for image data input by the scanner units 24Y, 24M, 24C, and 24K, which are exposure units, is transmitted to the photosensitive drums 22Y through 22K. Then the light selectively irradiates the surface of the photosensitive drums 22Y through 22K. In the above-described manner, electrostatic latent images are formed on the surface of the photosensitive drums 22Y through 22K based on the image data.

The development units 26Y, 26M, 26C, and 26K, which are development members, are provided to the stations, respectively. Each of the development units is rotationally driven by motors 6*a* through 6*d* illustrated in FIG. 1B. Each of the development units 26Y through 26K visualizes each corresponding electrostatic latent image formed on the surface of the photosensitive drums 22Y, 22M, 22C, or 22K by using a developer, such as a yellow (Y) toner, a magenta (M) toner, a cyan (C) toner, or a black (K) toner, as a monochromatic toner image.

The toner cartridges 25Y, 25M, 25C, and 25K are provided to the corresponding development units 26Y through 26K, respectively. The toner cartridges 25Y through 25K supply color toners to the development units 26Y through 26K. Sleeves 26YS, 26MS, 26CS, and 26KS are provided to the development units 26Y through 26K, respectively. The development units 26Y through 26K are detachably mounted to the image forming apparatus.

The intermediate transfer belt 27, which is an intermediate transfer member, contacts the photosensitive drums 22Y through 22K. In addition, during image forming, the intermediate transfer belt 27 rotates in the clockwise direction according to the rotation of the photosensitive drums 22Y through 22K. The intermediate transfer belt 27 is driven and rotated by the drive force from a belt drive roller 40 in the clockwise direction.

Figure 1B:
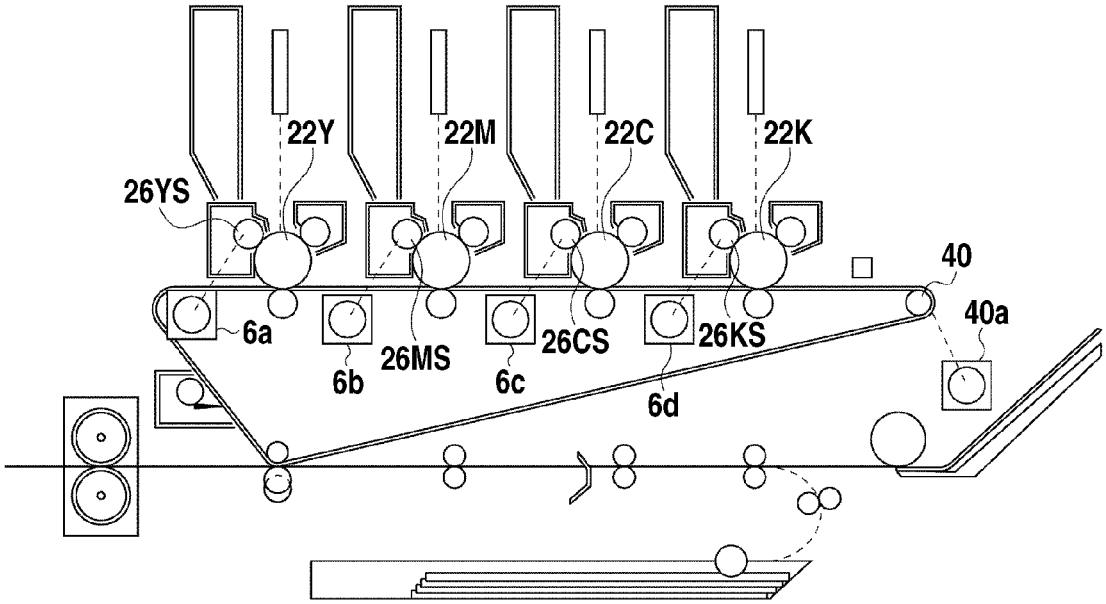

The drive roller 40 is driven and rotated by a motor 40*a* illustrated in FIG. 1B. The monochromatic toner images formed on the surface of the photosensitive drums 22Y through 22K are transferred onto the intermediate transfer belt 27 in a mutually overlapping manner to form a multicolor toner image.

Subsequently, the transfer roller 28, which is a transfer member, comes into contact with the intermediate transfer belt 27. In this state, the recording paper 11, which has been conveyed from the paper feed units 21*a* and 21*b*, is pinched between the intermediate transfer belt 27 and the transfer roller 28 to be further conveyed. In this manner, the multicolor toner image on the intermediate transfer belt 27 is transferred onto the recording paper 11.

The transfer roller 28 can contact (at a position 28*a*) and can be separated from (by moving to a position of 28*b*) the intermediate transfer belt 27. More specifically, during the transfer of the multicolor toner image on the recording paper 11, the transfer roller 28 contacts the intermediate transfer belt 27 at the position 28*a*. On the other hand, after the image forming, the transfer roller 28 is separated from the intermediate transfer belt 27 by moving to the position 28*b*.

While conveying the recording paper 11, the fixing unit 30, which is a fixing member, fusion-fixes the multicolor toner image that has been transferred onto the recording paper 11. The fixing unit 30 includes a fixing roller 31, which applies heat to the recording paper 11, and a pressure roller 32, which presses the recording paper 11 against the fixing roller 31 by applying pressure thereto. Both the fixing roller 31 and the pressure roller 32 have a hollow structure and include heaters 33 and 34 therein, respectively.

After the multicolor toner image has been fixed thereon, the recording paper 11 is discharged by a discharge roller (not illustrated) onto a paper discharge tray (not illustrated). Then the image forming operation ends.

A cleaner 29, which is a cleaning member, removes toners remaining on the intermediate transfer belt 27. Waste toners, which may arise after having transferred the four-color multicolor toner images from the surfaces of the intermediate transfer belt 27 onto the recording paper 11, are collected into a cleaner container of the cleaner 29.

<Configuration and Function of Density Sensor>

Figure 2:
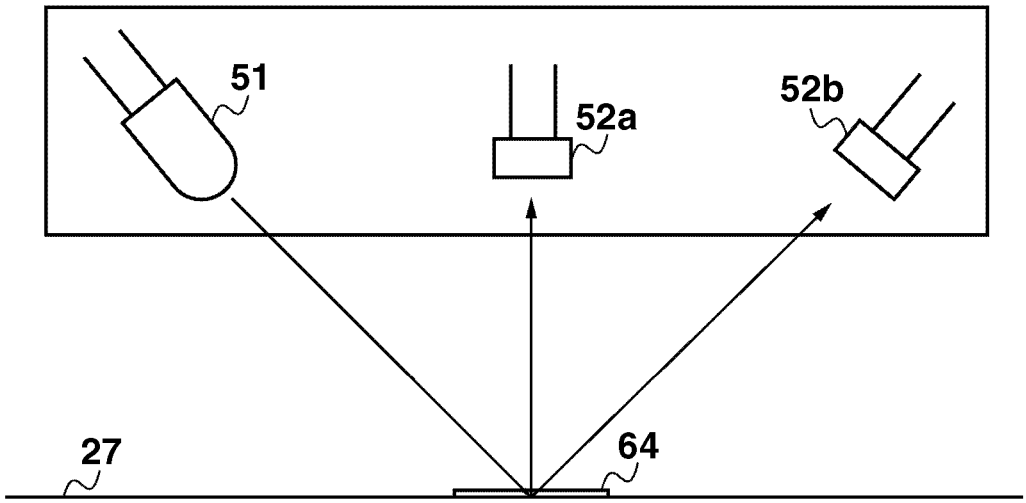
FIG. 2 illustrates an exemplary configuration of a density sensor.

A density sensor 41 is provided within the image forming apparatus illustrated in FIG. 1 and faces the intermediate transfer belt 27. FIG. 2 illustrates an exemplary configuration of the density sensor 41. More specifically, the density sensor 41 includes an infrared-emitting element 51, such as a light-emitting diode (LED), and a light receiving element 52, such as a photodiode or cadmium sulfide (Cds). The light receiving element 52*a* detects the level of irregular reflection light from a toner patch 64 acquired when the toner patch 64 is irradiated with light by using an LED. By deducting the level of irregular reflection light, which is detected by the light receiving element 52*a* according to a result of a detection by the light receiving element 52*b*, which detects the level of regular reflection light from the toner patch 64. Accordingly, the level of the regular reflection light can be precisely detected. In addition, information equivalent to the density of the toner patch 64 can be detected based on the result of detection of the regular reflection light level.

<Configuration and Function of Encoder>

Figure 3:
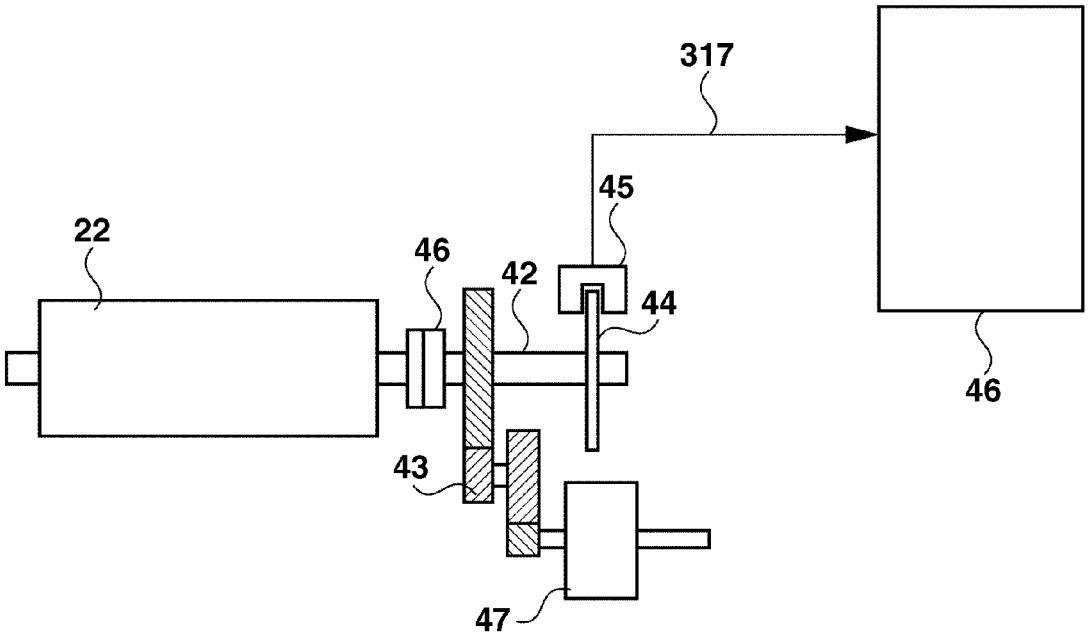
FIG. 3 illustrates examples of a rotation state detection unit, a rotation and driving source unit, and a drive force transmission unit.

Now, an exemplary method for detecting unevenness of the rotation speed of the photosensitive drum, which is the SSD density variation cause that may occur as the photosensitive drum (i.e., the rotation member for forming toner images on the image bearing member) rotates, will be described in detail below with reference to FIG. 3. In the following description, the color of yellow (Y) will be described as a representative color of the colors of CMYK. However, the image forming apparatus according to the present exemplary embodiment actually has the same configuration for the colors other than the color of Y (i.e., C, M, and K), independently for respective colors.

A rotation shaft 42 rotates together with the photosensitive drum 22Y, which is the rotation member used for image forming. A deceleration gear 43 transmits the rotation of the drive motor 47 to the rotation shaft 42. A code wheel 44, which rotates together with the rotation of the rotation shaft 42, has slits, which are concentrically provided at equal intervals. An encoder 45 includes a light emission unit and a light receiving unit. The encoder 45 outputs a pulse signal according as the slit of the code wheel 44 goes by.

A calculation unit 46 performs calculation processes on the pulse output from the encoder 45. In addition, the calculation unit 46 calculates information about the SSD density variation cause that may occur due to unevenness of the rotation speed of the photosensitive drum 22Y, which is the rotation member.

In the present invention, the "SSD density variation cause" is equivalent to the amount of deviation from an ideal laser writing interval in the sub scanning direction. However, the SSD density variation cause according to the present invention is not limited to this. More specifically, instead of the ideal laser writing interval in the sub scanning direction itself, information that indicates the ideal laser writing interval in the sub scanning direction can be appropriately used as the SSD density variation cause. Since the positional deviation may occur due to variation of the speed, the SSD density variation cause can be expressed as a parameter to the speed.

The encoder 45 has two light receiving units. More specifically, the encoder 45 has a function for detecting a home position of the code wheel 44 as well as a rotation speed detection function. The detection result is transmitted to an SSD density variation cause calculation unit 46. More specifically, the encoder 45 detects the home position of the code wheel 44 to determine the phase of periodic unevenness of the rotation speed. Processing executed by the SSD density variation cause calculation unit 46 will be described in detail below.

<Functional Blocks of Image Forming Apparatus>

Figure 4:
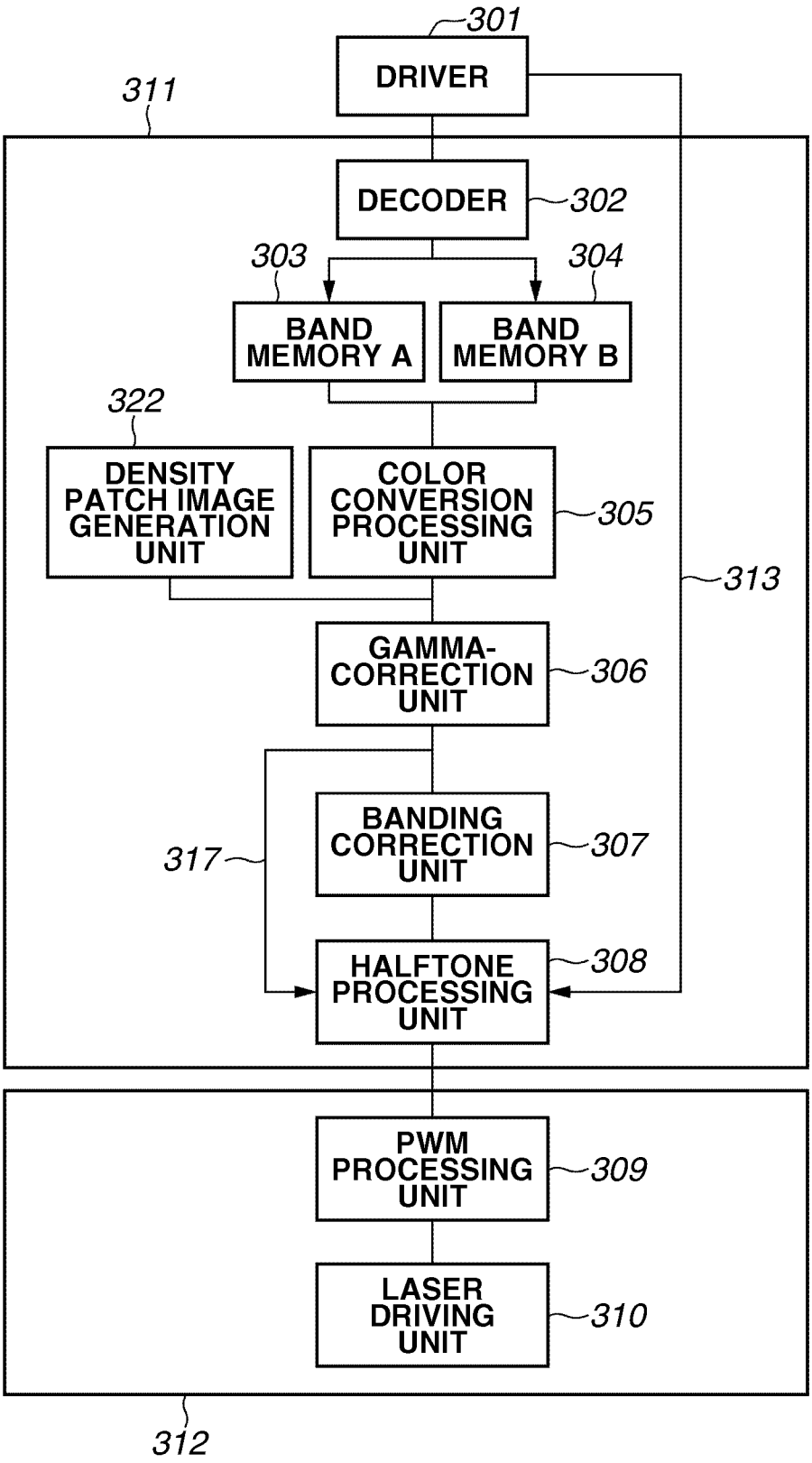
FIG. 4 illustrates exemplary functional blocks of the image forming apparatus.

Now, a configuration of the image forming apparatus according to the exemplary embodiment of the present invention related to processing on a signal will be described in detail below with reference to FIG. 4. FIG. 4 is a functional block diagram illustrating an exemplary configuration of the image forming apparatus according to the present exemplary embodiment related to processing on a signal.

For example, when a print command is input by a host computer (not illustrated), page description language (PDL) data, which is print data, is transmitted from a driver 301 installed on the host computer. Then the print data is input to a controller 311 included in the image forming apparatus.

In printing, an attribute of the print data to be printed by using the driver 301 is designated by a user by designating an image attribute, such as a document image, a graphic image, or a photographic image by hand. Alternatively, the image attribute can be automatically determined by an application. The determined attribute of the print data is input to a halftone processing unit 308 as halftone information 313.

The controller 311 includes a decoder 302, a band memory A 303, a band memory B 304, a color conversion processing unit 305, a gamma-correction unit 306, a banding correction unit 307, and the halftone processing unit 308. The input print data (for example, PDL data) is interpreted by the decoder 302 and is then converted into 8-bit RGB image data.

The RGB image data is input into the band memory. The band memory includes two memory devices, such as the band memory A 303 and the band memory B 304. One memory can store image data of several lines.

At first, an image region for the top predetermined number of lines is rasterized onto the band memory A 303. Then while another image region for the next predetermined number of lines is rasterized onto the band memory B 304, RGB image data is output from the band memory A 303.

Furthermore, while another image region of a next predetermined number of lines is rasterized onto the band memory A 303, RGB image data is output from the band memory B 304. Thus, image data is rasterized onto and output from two band memories, alternately.

The RGB image data output from the band memory A 303 and the band memory B 304 is input in parallel to the color conversion processing unit 305. After being input to the color conversion processing unit 305, the RGB image data is subjected to predetermined color conversion processing and under color removal (UCR), and is then converted into YMCK image signals.

In the present exemplary embodiment, the image forming apparatus forms one frame for each of the YMCK colors. Accordingly, image signals are output from the color conversion processing unit 305 in order of color frames, i.e., in order of data of one frame of a Y image, data of one frame of an M image, and data of one frame of a C image, and data of one frame of a K image, chronologically with difference in timings.

The gamma-correction unit 306 converts each color image signal output from the color conversion processing unit 305 into corrected signal, which is corrected based on information stored in a gamma-correction table (hereinafter may also be referred to as a "density correction table", which will be described in detail below) in order to maintain linearity of the gradation characteristic of the halftone with respect to the image signal.

Subsequently, the banding correction unit 307, which will be described in detail below, converts the image signal output from the gamma-correction unit 306 into signals corrected with a characteristic reverse to the characteristic of the image banding that may occur due to the SSD density variation cause. Then the halftone processing unit 308 executes halftone processing on the converted signal by dithering.

The engine 312 includes a pulse width modulation (PWM) processing unit 309 and a laser drive unit 310. The image signal supplied from the controller (i.e., an image signal supply source) 311, after being subjected to the halftone processing by the halftone processing unit 308, is subjected to pulse width modulation by the PWM processing unit 309 to be digital-to-analog (D/A)-converted. Then, the converted signal is input to the laser drive unit 310.

The laser drive unit 310 controls the scanner unit 24 according to the input data. After that, the electrophotographic process described above with reference to FIG. 1 is executed, and then the image data is printed on the recording paper 11.

<Configuration and Function of Main Control Unit>

Figure 5:
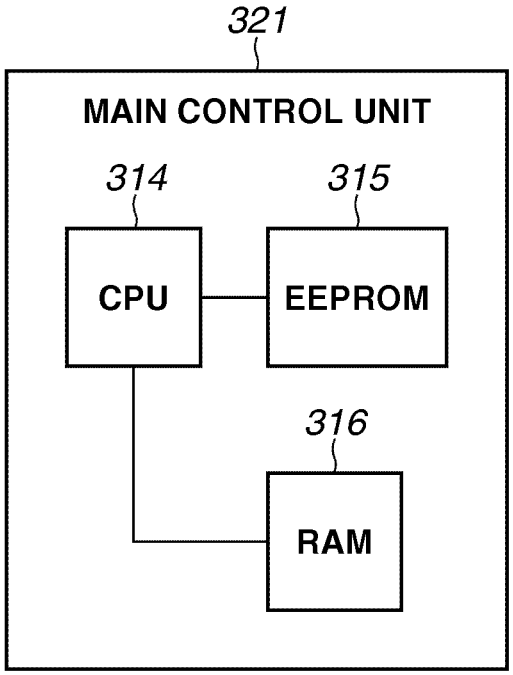
FIG. 5 illustrates an example of a main control unit.

FIG. 5 is a block diagram illustrating an exemplary configuration of a main control unit of the controller 311 described above. The main control unit 321 at least includes a central processing unit (CPU) 314, an electrically erasable programmable ROM (EEPROM) 315, and a random access memory (RAM) 316.

The signal processing units illustrated in FIG. 4 are connected with a main control unit 321 via a signal line (not illustrated). Accordingly, the main control unit 321 controls (instructs) each signal process ing unit to store, read, or write data. Processing executed by the main control unit 321 is executed by the CPU 314 by loading and executing program codes from the EEPROM 315.

In the present exemplary embodiment, the main control unit 321 or the CPU 314 implements the function of the banding correction unit 307 described above. However, the present invention is not limited to this. More specifically, instead of using the main control unit 321, the function of the banding correction unit 307 can be implemented by an application specific integrated circuit (ASIC) or by a cooperation between the main control unit 321 and an ASIC.

In addition, each block different from the banding correction unit 307 can be implemented by the main control unit 321, an ASIC, or a combination thereof as the banding correction unit 307. Although not illustrated in the drawing, the engine 312 has a configuration similar to that of the main control unit 321 illustrated in FIG. 5. With the configuration similar to that of the main control unit 321, the engine 312 executes various controls on the blocks included therein.

<Method for Controlling Image Density>

Now, image density control according to the present exemplary embodiment will be described in detail below. The density of a printed image may vary due to various causes, such as the operation state (the operation environment) of image forming, such as the temperature and the humidity inside or outside (the installation location of) the image forming apparatus, the level of consumption or degradation of the photosensitive member, and the operation state (the operational circumstances) of the image forming, such as the number of continuously printed sheets.

In addition, in order to prevent density variation, many image forming apparatuses include an image density control mechanism, which automatically controls a charging potential, an exposure amount, a development bias, or image forming conditions such as gradation control conditions. In the present exemplary embodiment, the image forming apparatus executes the image density control when the image forming apparatus is powered on or when a predetermined number of sheets is printed.

Now, an example of gradation control, which is an example of the image density control, will be described in detail below. The present exemplary embodiment executes the gradation control in order to maintain the linearity of the gradation characteristic of halftone with respect to the gradation value of the image signal. In the present exemplary embodiment, after detecting a plurality of density patches, which has been formed at different gradations, by using a density sensor, a gamma-correction table is corrected so that an input/output (I/O) characteristic becomes linear, based on the result of the detection of the density patch. Now, the gradation control processing according to the present exemplary embodiment will be described in detail below.

Figure 6A:
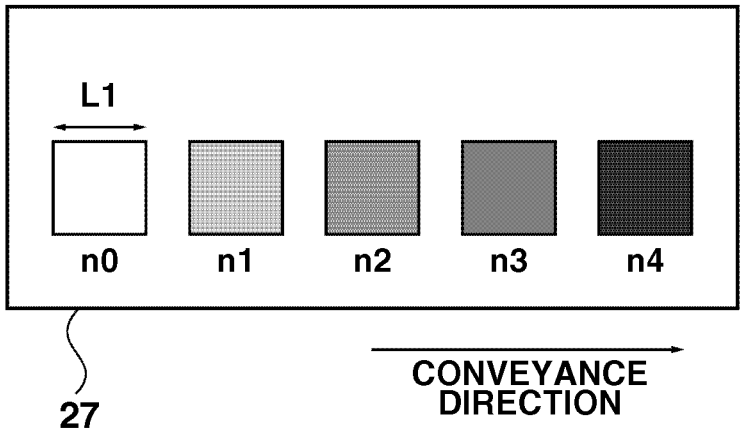
FIGS. 6A and 6B illustrate an example of a patch image.

When it is instructed by the CPU 314 to form a patch, the patch image generation unit 322 generates patch images illustrated in FIG. 6A. The generated images are formed on the intermediate transfer belt 27 as patch images by the electrophotographic process after having been subjected to processing by the gamma-correction unit 306, the halftone processing unit 308, the PWM processing unit 309, and the laser drive unit 310.

Each of the patch images illustrated in FIG. 6A has gradations n0 through n4. In outputting the patch image, a through gamma-correction table 601 (FIG. 6B) is used. An image signal 317, which has not been subjected to processing by the banding correction unit 307 yet, is input to the halftone processing unit 308 by a signal switching unit (not illustrated). The density of the patch images formed on the intermediate transfer belt 27 can be detected by the density sensor 41.

Figure 6B:
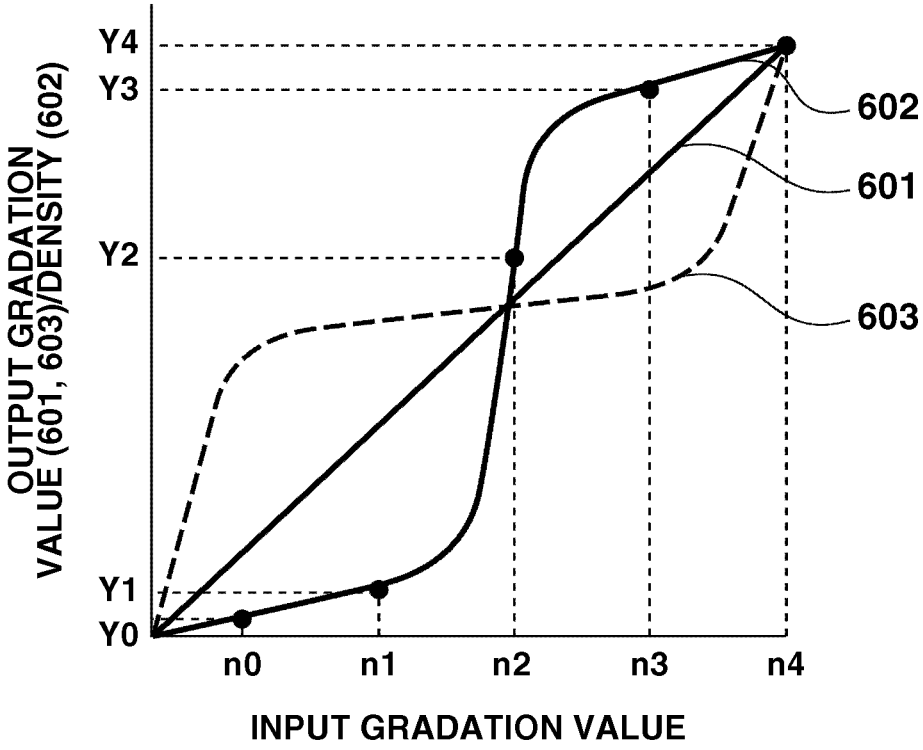

Suppose that density patches n0 through n4 have density Y0 through Y4, respectively. The present exemplary embodiment generates a density characteristic table (a reference density characteristic table) for all gradations by executing interpolation calculation based on the calculated density. A table 602 illustrated in FIG. 6B is an example of the reference density characteristic table. The density is taken on a vertical axis of the reference density characteristic table 602. Then a gamma-correction table 603 is calculated to be provided with a characteristic reverse to the characteristic of the reference density characteristic 602. An output gradation value of the gamma-correction unit 306 is taken on the vertical axis of a table 603.

In the above-described gradation control, the density patch formed on the intermediate transfer belt 27 is collected by the cleaning unit illustrated in FIG. 1. In addition, maximum density control and the gradation control are executed for each halftone that can be selected by the halftone processing unit 308.

<Outline of Banding Correction Processing>

Now, an outline of banding correction processing will be described below. In the present exemplary embodiment, the image forming apparatus first measures rotation unevenness of the photosensitive drum, which is the SSD density variation cause, by using the encoder illustrated in FIG. 3. In addition, by referring to a previously stored conversion table (i.e., a table storing the correspondence between the SSD density variation cause and a banding correction value) based on the acquired SSD density variation cause, the present exemplary embodiment acquires an appropriate banding correction value.

More specifically, the level of banding correction to be executed for a specific SSD density variation cause is determined according to which reference table to be selected based on the dot reproductivity estimated at the timing of the banding correction.

As will be described in detail below, the "dot reproductivity" is used to indirectly identify the level of banding (the amplitude level) of density variation with respect to a specific SSD density variation cause or the level of banding correction (the level of density correction). In other words, the dot reproductivity does not have a characteristic according to the frequency of the variation of the density variation cause. To paraphrase this, the dot reproductivity does not directly denote the density characteristic having the periodical characteristic that may vary according to the variation of the SSD density variation cause.

In the present exemplary embodiment, a plurality of conversion tables used for acquiring the banding correction level is stored, each of which corresponds to each dot reproductivity. In other words, unless the density variation synchronized with the SSD density variation cause is directly measured, an appropriate level of banding correction (the conversion table) can be acquired by utilizing the dot reproductivity information, which is indirect density variation information that indirectly indicates the level of the density variation or the level of density correction. Accordingly, banding correction by the correction level determined according to the variation of the density characteristic of the image forming apparatus can be easily implemented.

In the following description, the processing according to the present exemplary embodiment will be described in the following order:

(1) Dot reproductivity information acquisition processing (2) Banding correction processing In the following description, the color of yellow (Y) will be described as a representative color of the colors of CMYK. However, the image forming apparatus according to the present exemplary embodiment actually executes the same processing for the colors other than the color of Y (i.e., C, M, and K).

(1) Dot Reproductivity Information Acquisition Processing

To begin with, the dot reproductivity information acquisition processing will be described in detail below. The dot reproductivity information acquisition processing is executed in order to estimate the state of dot reproductivity that may vary according to environmental variations, such as the temperature and the humidity inside or outside the image forming apparatus and the operation state of each cartridge, such as the degree of consumption and degradation. To begin with, the outline of the dot reproductivity information acquisition processing will be described.

In the present exemplary embodiment, a gamma-correction table (hereinafter simply referred to as a "reference gamma-correction table"), which has been associated with a plurality of dot reproduction states, is previously stored on the EEPROM 315. When the dot reproductivity information acquisition processing is started, the present exemplary embodiment executes the above-described gradation control. Then a reference gamma-correction table having a shape most similar to the shape of a gamma-correction table acquired by the gradation control (hereinafter simply referred to as a "measured gamma-correction table") is selected. In this manner, the state of the dot reproductivity is identified. Processing for identifying the dot reproductivity will be described in detail below.

Then index information (e.g., "state 1", "state 2", and the like) that denotes the dot reproductivity, which is a result of the selection, is stored on the RAM 316. The index information is equivalent to the dot reproductivity information.

(Effect of Utilizing Gamma-Correction Table to Identify Dot Reproductivity)

The gamma-correction table is utilized to identify the dot reproductivity because the dot reproductivity and the gamma-correction table have a correlation.

The dot reproductivity can be defined as follows. The dot reproductivity is "high" if dots have been formed at correct dot forming positions and if no dot is formed at a position at which no dot can be formed, i.e., on a white background portion. On the other hand, the dot reproductivity is "low" if a sufficient number of dots have not been formed at correct dot forming positions because a sufficient amount of toner has not been applied thereto or if the toner is adversely applied to a portion among dots, which should essentially be left blank as a space.

In the following description, an exemplary relationship between the dot reproductivity and the measured gamma-correction table will be described in detail below focusing on a case where the dot reproductivity is degraded. For example, a case where a new toner CRG (hereinafter simply referred to as a "new CRG") and a case where a toner CRG whose amount of remaining toner is small (hereinafter simply referred to as a "used CRG") are compared. In this case, as a difference between the new and the used CRGs, the average grain size of the toner replenished to the image forming unit may be different. More specifically, the toner grain size of the new CRG is small while the toner grain size of the used CRG is large.

Cases where density patches for highlight regions are to be output by utilizing the new CRG and the used CRG will be described. A highlight image that has been subjected to the halftone processing is constituted by minute dots. If minute dots are formed by using the toner whose grain size is large, the dot reproductivity may degrade because the toner may not be securely applied. Accordingly, the dots may not be formed in the sufficient quantity. Therefore, in this case, the density of the highlight region may become low.

On the other hand, cases where density patches for a shadowed region are to be output by using the new CRG and the used CRG will be described. In an image of a shadowed region, the distance between dots is short. Accordingly, if the dots are formed by using the toner whose grain size is large, the dot reproductivity may degrade due to increased toner scatter, which may occur due to an affect from adjacent dots. Furthermore, in this case, the area of the white background region that should exist among dots may be reduced. Therefore, it is likely that the density is high.

Figure 7A:
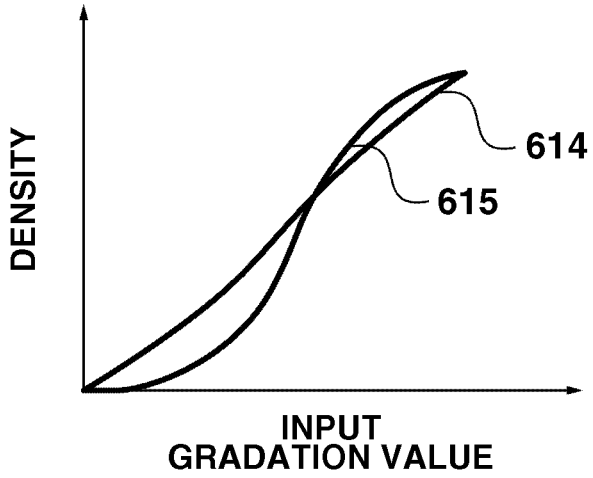
FIGS. 7A and 7B illustrate a gradation characteristic.

As described above, the density of a highlight region, whose dots have been formed by using the used CRG having a dot reproductivity lower than that of a case where the dots have been formed by using the new CRG having a higher dot reproductivity, is likely to become low while the density of a shadowed region is likely to become high. FIG. 7A illustrates an exemplary density characteristic in relation to the gradations of the new CRG and the used CRG.

Figure 7B:
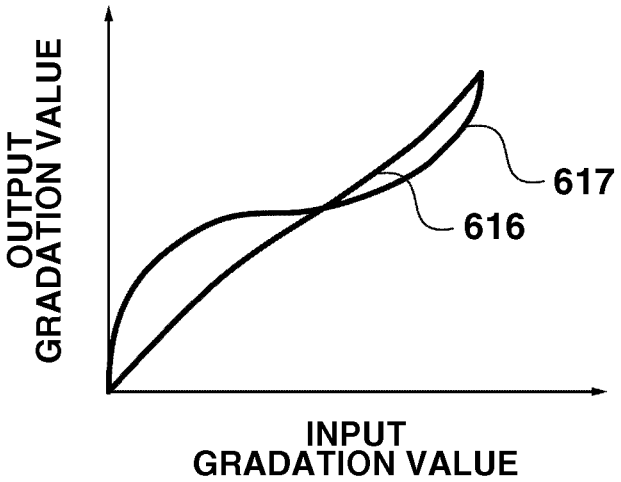

The density variation of a new CRG 614 with respect to the gradation is relatively linear as illustrated in FIG. 7A. On the other hand, if the dots have been formed by using the used CRG, a curve 615 indicates that the density of the highlight region is low while the density thereof sharply rises at middle density levels and the density of the shadowed region becomes high. As a result, a measured gamma-correction table for the new and the used CRGs illustrated in FIG. 7B (a curve 616 corresponding to the case where the new CRG is used while a curve 617 corresponds to the used CRG) can be acquired.

As described above, in the present exemplary embodiment, a case where the measured gamma-correction table is generated based on the toner grain sizes of the new and the old CRGs. However, the shape of the measured gamma-correction table may vary due to the dot reproductivity, which may vary due to the degradation of the photosensitive drum caused by aging, and due to the environmental variation, such as the temperature and the humidity inside and outside the image forming apparatus. As described above, the dot reproductivity may vary due to various conditions of the image forming apparatus. However, the dot reproductivity and the shape of the measured gamma-correction table have a specific relationship. In the present exemplary embodiment, processing for determining the level of the banding correction is executed according to the dot reproductivity estimated by utilizing the gamma-correction table.

(Reference Gamma-Correction Table)

Now, an exemplary method for calculating a reference gamma-correction table will be described. By changing the operation environment, the operation state, and various conditions, such as image processing conditions (dithering conditions to be applied), the dot reproductivity can be varied. By using the varied dot reproductivity, the state of dot reproductivity under each condition can be defined. In the following example, two dot reproduction states (the state 1 and the state 2) are defined.

Figure 8:
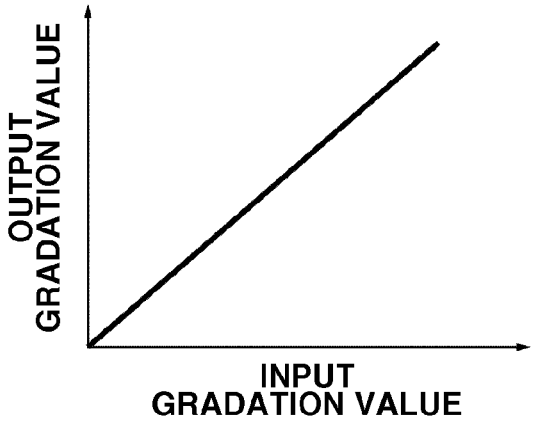
FIG. 8 illustrates an example of information referred to in processing for identifying dot reproductivity.
Figure 8:
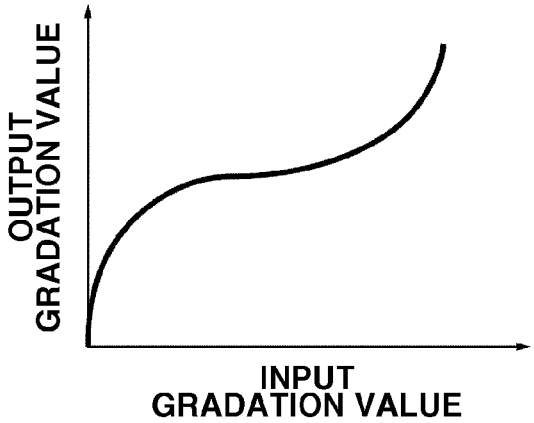

Subsequently, the gradation control described above with reference to FIGS. 6A and 6B is executed in each of the defined dot reproduction states (the state 1 and the state 2) to calculate and generate each reference gamma-correction table. FIG. 8 illustrates an example of the reference gamma-correction table in each dot reproduction state. In the example illustrated in FIG. 8, the gamma-correction table in each state is stored on the EEPROM 315.

The reference gamma-correction table is written on the EEPROM 315 based on measured density at various timings, such as the development of the product, the shipment from the factory, when the service is executed on the apparatus, when the toner CRG is exchanged, and when the image forming apparatus is calibrated.

(Flow of Dot Reproductivity Information Acquisition Processing)

Now, an exemplary flow of dot reproductivity information acquisition processing will be described in detail below with reference to FIG. 9.

Figure 9:
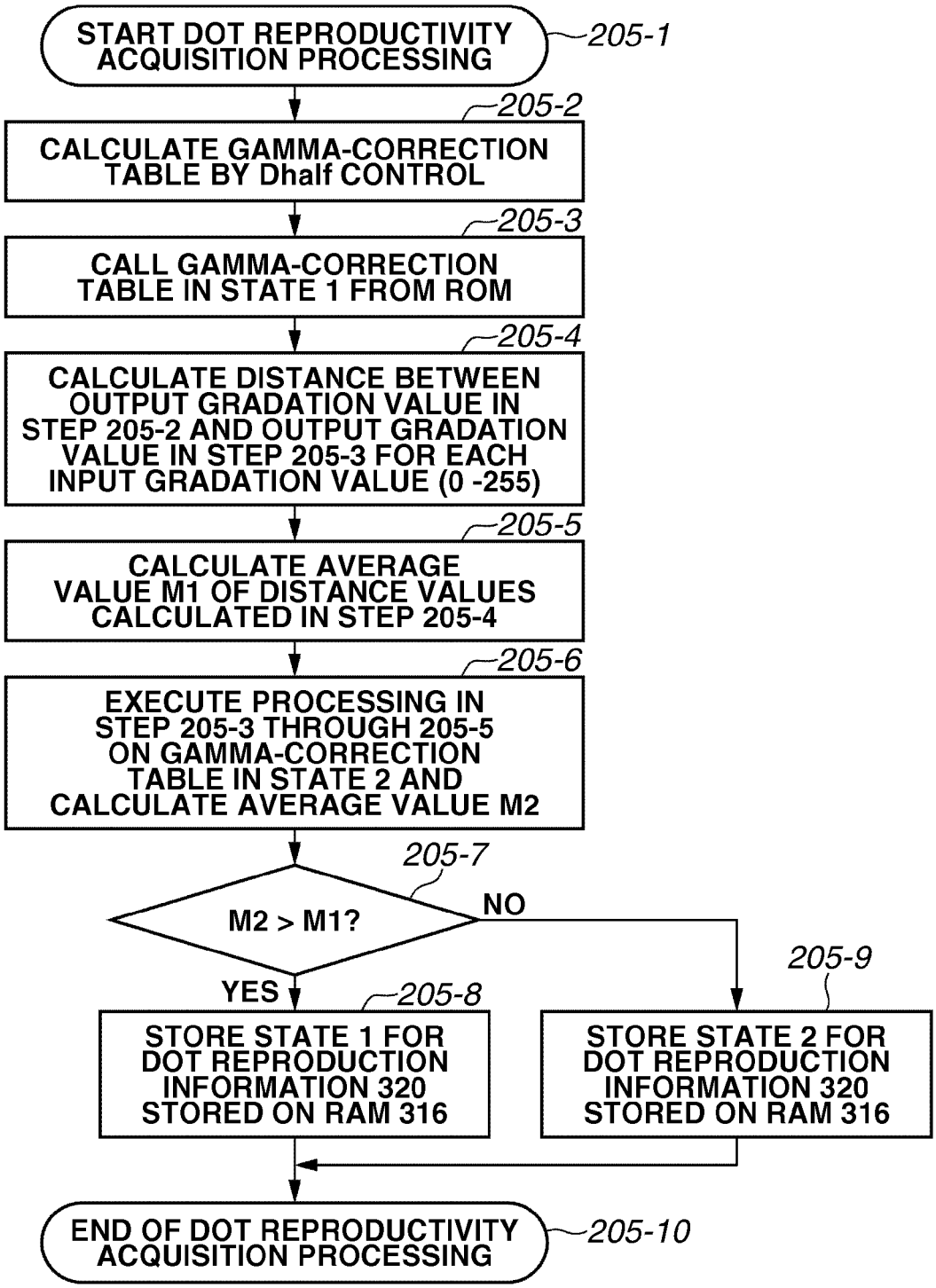
FIG. 9 is a flow chart illustrating an exemplary flow of processing for identifying the dot reproductivity.

Referring to FIG. 9, in step 205-1, the image forming apparatus starts the dot reproductivity acquisition processing according to an instruction input by the CPU 314. In the present exemplary embodiment, to "acquire" refers to an operation executed by a processing subject unit for reading desired information from a storage unit, such as a RAM. "Acquisition" operations can be distinguished from one another by describing the "Acquisition" operations as a "first acquisition", a "second acquisition", a "third acquisition", and the like.

In step 205-2, the CPU 314 (a dot reproductivity analysis unit 3071, which will be described below) executes the gradation control described above with reference to FIGS. 6A and 6B to generate the gamma-correction table. However, if the processing according to the flow chart of FIG. 9 is executed subsequently to the normal gradation control, the processing in step 205-2 can be omitted. In step 205-3, the CPU 314 copies on the RAM 316 the reference gamma-correction table in the state 1, which has been previously stored on the EEPROM 315.

In step 205-4, the CPU 314 calculates the distance (difference) between the output gradation value stored in the gamma-correction table calculated in step 205-2 and the output gradation value in the state 1 copied in step 205-3 for each input gradation value (0-255). In the present exemplary embodiment, the "distance" refers to a parameter indicating the difference amount. However, the present exemplary embodiment is not limited to this. More specifically, another parameter with which the difference amount can be evaluated can be used instead.

Let the value of the gamma-correction table calculated in step 205-2 be "γpi (i=0, 1, . . . 255) and the value of the gamma-correction table (the reference gamma-correction table) calculated in step 205-3 be γqi (i=0, 1, . . . 255). Then, a distance γdi (i=0, 1, . . . 255) for each input gradation value can be calculated by the CPU 314 by using the following expression:

$$\gamma di=|\gamma pi-\gamma qi|.$$

In step 205-5, the CPU 314 calculates a mean value M1 of the distances γdi calculated in step 205-4. In step 205-6, the CPU 314 processes the gamma-correction table for the state 2 by executing steps 205-3 through S205-5 as described above to calculates a mean value M2.

In step 205-7, the banding correction unit 307 compares the mean values M1 and M2. If it is determined that the value M2 is greater than the value M1 (Yes in step 205-7), then the processing proceeds to step 205-8. On the other hand, if it is determined that the value M2 is equal to or less than the value M1 (No in step 205-7), then the processing proceeds to step 205-9.

In step 205-8, the banding correction unit 307 stores the "state 1" for the dot reproduction information on the RAM 316. On the other hand, the banding correction unit 307 stores the "state 2" for the dot reproduction information on the RAM 316. In step 205-10, the banding correction unit 307 ends the dot reproductivity acquisition processing.

In the image forming apparatus according to the present exemplary embodiment, when the engine is powered on or when a predetermined number of sheets has been printed, the banding correction unit 307 executes the dot reproductivity information acquisition processing described above with reference to FIG. 9.

By executing the above-described processing, the CPU 314 can appropriately estimate the dot reproductivity information by selecting a gamma-correction table having a similar shape from the reference gamma-correction table in a plurality of dot reproduction states that has been previously stored.

In the above-described example, it is supposed that two states have been defined for the dot reproductivity. However, three or more states can be defined in the present exemplary embodiment. More specifically, in this case, the dot reproductivity can be calculated by repeatedly executing processing similar to that insteps 205-3 through 205-5 for each state. Furthermore, alternatively, the processing in step 205-3 and beyond can be executed by omitting the gradation control in step 205-2 and by using a gamma-correction table calculated by the latest gradation control.

(2) Banding Correction Processing

Now, banding correction processing according to the present exemplary embodiment will be described. By executing banding correction processing, the present exemplary embodiment can reduce visible banding by correcting the image signal having a characteristic reverse to the characteristic of the banding that has occurred due to the SSD density variation cause. To begin with, the outline of the processing will be described.

In the present exemplary embodiment, an SSD density variation cause-density correction value conversion table (hereinafter simply referred to as a "conversion table"), which stores a relationship between the SSD density variation cause and the characteristic reverse to the characteristic of the banding occurring due to the SSD density variation cause has been previously stored on the EEPROM 315. For the conversion table, an optimum table is calculated for each condition (the dot reproductivity, the type of halftone, and the gradation value). The conversion table associated with each condition is stored.

In the present exemplary embodiment, the CPU 314 refers to information about the dot reproductivity and information about the halftone (the halftone type) during image forming, and selects a corresponding conversion table. In addition, during image forming, the CPU 314 calculates the SSD density variation cause on each scan line based on SSD density variation cause information, which will be described in detail below. Furthermore, the CPU 314 refers to the selected conversion table to calculate a density correction value. Moreover, the CPU 314 corrects the image signal based on the calculated density correction value.

In the following description, the present exemplary embodiment will be described in the following order of (A) through (C).

(A) SSD density variation cause information (B) Conversion table stored on the EEPROM 315

(C) Processing related to banding correction (A) Description about SSD Density Variation Cause Information Now, a method for acquiring the SSD density variation cause information will be described in detail below.

In the present exemplary embodiment, it is supposed that the SSD density variation cause 605 has occurred in two periods of periods T1 and T2 (e.g., the period T1 has a period of 3 mm while the period T2 has a period of 0.8 mm), which exist in the frequency band highly visible against visual characteristic. Accordingly, a case of correcting banding will be described focusing on this state.

Figure 10:
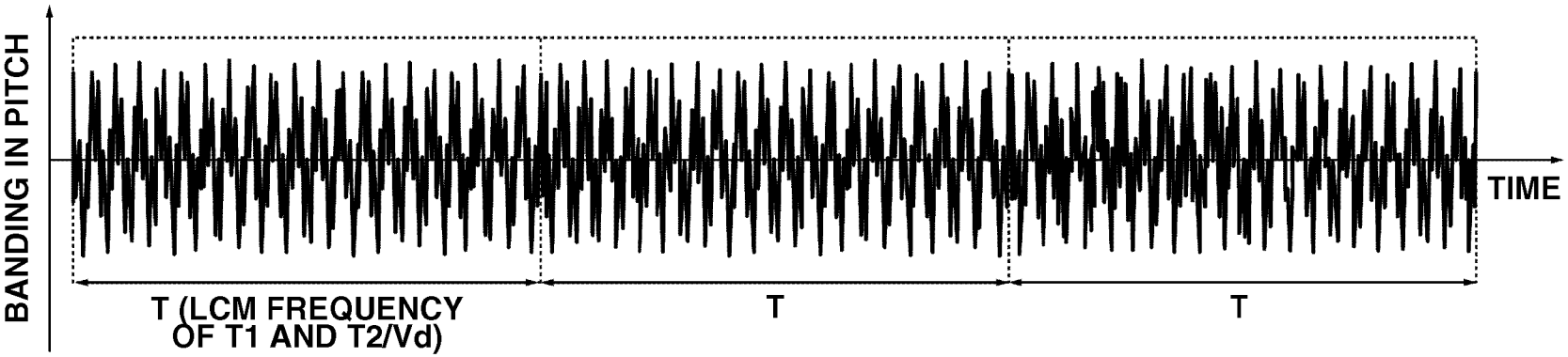
FIG. 10 illustrates an exemplary waveform of an SSD density variation cause.

FIG. 10 illustrates an exemplary waveform of the SSD density variation cause 605 measured by the encoder 45. The SSD density variation cause 605 repeatedly occurs at a period of the least common multiple (LCM) T' of the period T1 and T2. The SSD density variation cause information is a value of the SSD density variation cause repeatedly occurring every time "time T" (=T'/Vd) elapses since reference time t0 where "Vd" [mm/sec] denotes a target speed of the photosensitive drum 22Y.

A value of the SSD density variation cause at arbitrary time t can be acquired by referring to the SSD density variation cause at time $t'=\{Mod((t-\Delta T)-t0, T)\}$ considering the repeating relationship described above with reference to FIG. 10. In the present exemplary embodiment, "Mod(a, b)" denotes the remainder of a/b. The processing for referring to the value of the SSD density variation cause can be executed by the CPU 314 by calculation according to a program (not illustrated) stored on the EEPROM 315 and by returning a calculation result.

Now, the SSD density variation cause calculation unit 46 (FIG. 4), which is means used for calculating the SSD density variation cause information will be described. In the following description, the following symbols are used:

Vd: Target speed [mm/sec] of the photosensitive drum 22Y

Td: Perimeter [mm] of the photosensitive drum 22Y ns: number of slits of the code wheel 44 it is supposed that the values Vd, Td, and ns have been previously stored on the EEPROM 315.

(Flow of SSD Density Variation Cause Calculation Processing)

Figure 11:
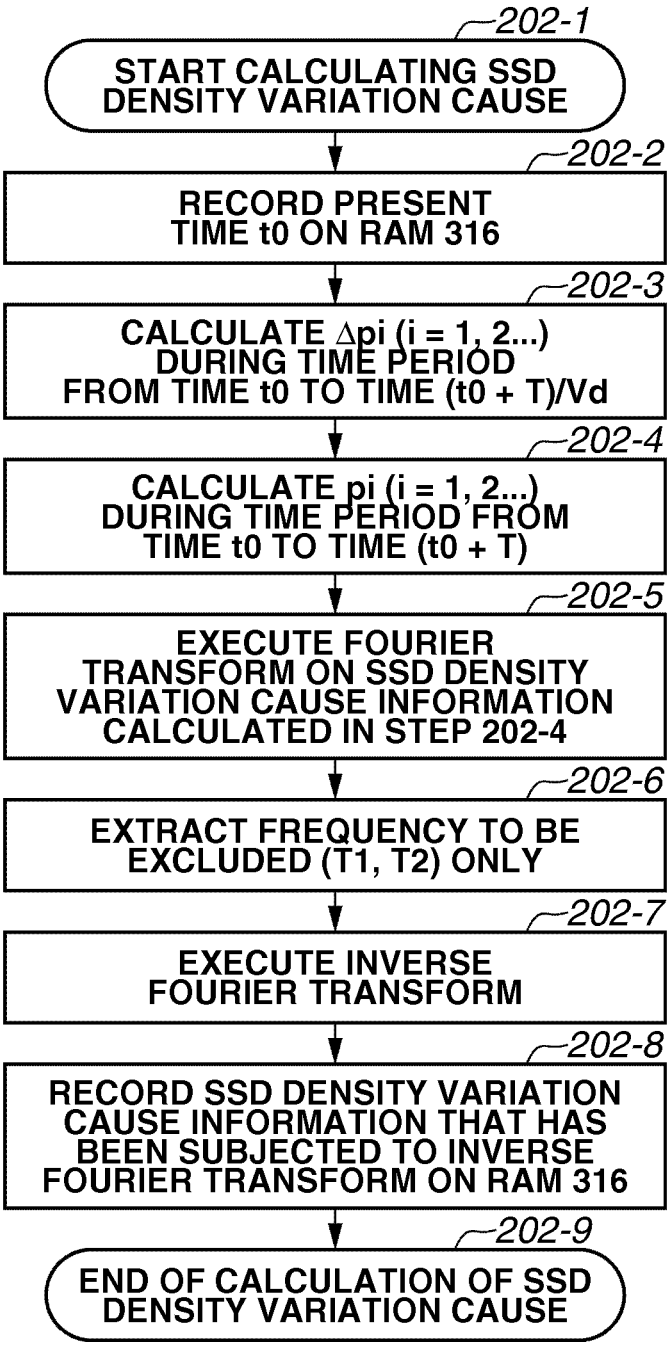
FIG. 11 is a flow chart illustrating an exemplary flow of processing executed by an SSD density variation cause calculation unit.

FIG. 11 is a flow chart illustrating an exemplary flow of processing executed by the SSD density variation cause calculation unit 46 (hereinafter simply referred to as the "calculation unit 46"). Referring to FIG. 11, in step 202-1, when an instruction is input by the CPU 314, the processing by the SSD density variation cause calculation unit 46 starts.

In step 202-2, the calculation unit 46 records the present time ("t0") on the RAM 316. In the present exemplary embodiment, "time" refers to information that can identify a specific timing. More specifically, time elapsed since a specific timing can be used as the time.

In step 202-3, the calculation unit 46 monitors switching (ON/OFF states) of the pulse of an encoder output signal 48 during a time period from the time t0 to the time (t0+T) and calculates interpulse time $\Delta pi$ (i=1, 2, . . . n). The term "n" is an integer less than the number of pulse signals from the encoder 45 corresponding to one revolution of the photosensitive drum. The term "T" can be calculated by dividing the LCM period of the timings T1 and T2 by Vd.

In step 202-4, the SSD density variation cause calculation unit 46 converts a value calculated by deducting ideal interpulse time Δp0 (Δp0=Td/Vd/ns) of a case where the photosensitive drum 22Y currently rotates at a constant speed from each calculated interpulse time Δpi into the distance on the intermediate transfer belt 27. In this manner, the SSD density variation cause information pi (pi={Δpi−Δp0}×Vd) (i=1, 2, . . . n).

In the present exemplary embodiment, it is supposed that the conveyance speed of the intermediate transfer belt 27 is the same as the speed Vd of the photosensitive drum 22Y. In the following description, the SSD density variation cause information, for example, pi will be described. However, the present exemplary embodiment is not limited to this. More specifically, any parameter, which is information capable of describing the substantial variation of intervals between the laser scan lines in each case, can be used as the SSD density variation cause information.

In step 202-5, the calculation unit 46 performs Fourier transform on the SSD density variation cause information pi. In step 202-6, the SSD density variation cause calculation unit 46 extracts components of the periods T1 and T2 from the data that has been subjected to Fourier transform.

In step 202-7, the calculation unit 46 executes inverse Fourier transform on the data calculated in step 202-6. In step 202-8, the SSD density variation cause calculation unit 46 overwrites the data that has been subjected to inverse Fourier transform calculated in step 202-7 and stores the same on the RAM 316 as pi. Then the processing by the SSD density variation cause calculation unit 46 ends (step 202-9). As will be described in detail below, the information stored on the RAM 316 is referred to by the banding correction unit 307 later and utilized in various calculations.

Alternatively, instead of the processing in steps 202-5 through 202-7, filtering including a combination of band-pass filtering, low-pass filtering, and high-pass filtering can be executed. The processing by the SSD density variation cause calculation unit 46 is executed before image forming.

More specifically, if two images are to be serially printed, the processing by the SSD density variation cause calculation unit 46 is executed before forming a first image. The result is utilized in the banding correction processing for forming the first image. Then the processing by the SSD density variation cause calculation unit 46 is executed in parallel to the image forming of the first image. A result of the processing is utilized in the banding correction processing when forming a second image.

(B) Description about Conversion Table

Now, the conversion table will be described in detail below.

As described above, the conversion table is associated with information about the image density, such as conditions of the dot reproductivity, the halftone type, and the gradation value, and is previously stored on the EEPROM 315. In other words, by selecting an appropriate conversion table according to the information about the image density, banding correction at an appropriate level can be implemented according to the environment and the state of the image forming apparatus at the present time.

Figure 12:
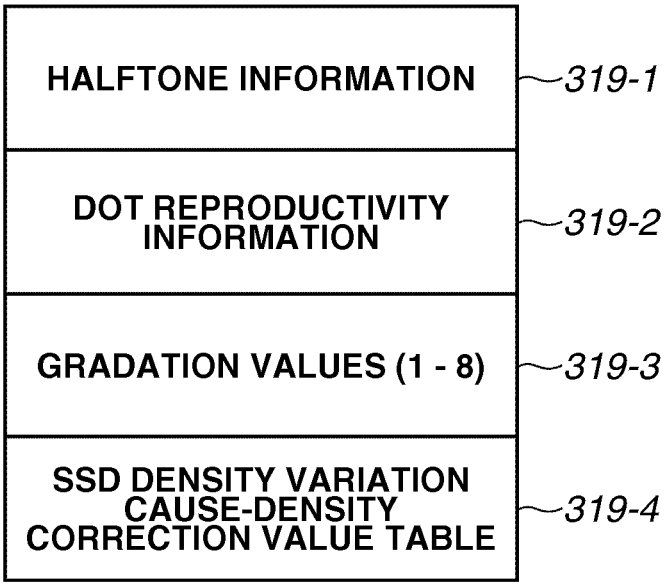
FIG. 12 illustrates exemplary information referred to in banding correction processing.

FIG. 12 illustrates an example of a set of the information described above. In the present exemplary embodiment, the information set is referred to as density correction information 319. In the example in FIG. 12, a conversion table (an SSD density variation cause-density correction value table) 319-4 is illustrated.

Referring to FIG. 12, attribute information 319-1 through 319-3 is attribute information stored in the conversion table 319-4. The information 319-1 through 319-3 is halftone information 319-1, dot reproductivity information 319-2, and gradation value 319-3.

A characteristic of the conversion table 319-4 will be described. The conversion table 319-4 stores a relationship between the value of each SSD density variation cause and the level of variation of density of image information to be varied.

Figure 13A:
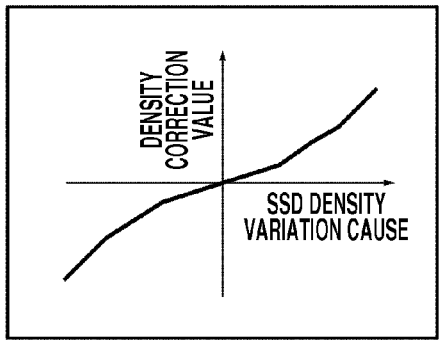
FIGS. 13A and 13B illustrate an example of an SSD density variation cause-density correction value conversion table.

FIG. 13A illustrates an example of the conversion table 319-4. In the example illustrated in FIG. 13A, if the SSD density variation cause is large (i.e., if the pitch is loose), the density correction value has a positive value because the density becomes relatively low in this case. On the other hand, if the SSD density variation cause is small (i.e., if the pitch is tight), the density correction value has a negative value because the density becomes relatively high in this case.

Now, an example of density correction information 319 will be described. The optimum conversion table 319-4 may differ according to the gradation value of the image signal, the dot reproductivity and the halftone type (i.e., the type of image processing to be executed). Accordingly, the present exemplary embodiment previously stores a predetermined gradation value 319-3, predetermined dot reproductivity information 319-2, and the conversion table 319-4 for each dithering type on the EEPROM 315.

Figure 13B:
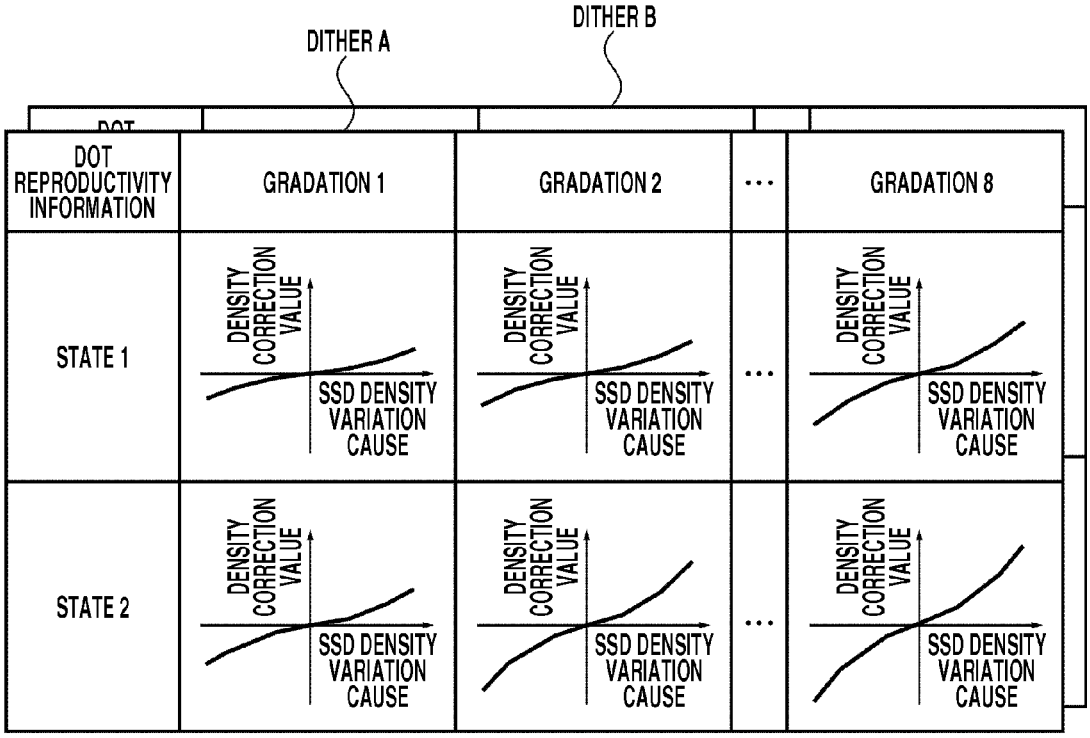

FIG. 13B illustrates an example of the conversion table. By using the conversion table illustrated in FIG. 13B, density correction at different levels can be implemented according to the current state even if the banding has occurred due to the same SSD density variation cause.

In FIG. 13B, an optimum conversion table 319-4 for each of the two dot reproductivity states (the state 1 and the state 2) at eight gradation levels (gradations 1 through 8) is illustrated. The optimum conversion table 319-4 differs according to the type of the halftone. Accordingly, the table illustrated in FIG. 13B is provided for each halftone type.

In FIG. 13B, two types of halftones, such as a dither A, which is a high resolution halftone, and a dither B, which is a low resolution halftone, are illustrated. As described above, in FIG. 13B, thirty-two (i.e. 2×8×2=32) patterns of density correction information 319 corresponding to each of the state 1 and the state 2 (the two types of halftones) are illustrated.

The conversion table 319-4 under each condition can be calculated by the following methods. For example, the density sensor 41 detects banding that occurs when a predetermined image is formed for each state, gradation, and halftone. At the same time, the encoder 45 detects the SSD density variation cause. Results of the above-described detections can be used for the calculation for the conversion table 319-4. In other words, the conversion table 319-4 can be calculated based on a relationship between the characteristic reverse to the characteristic of the measured banding and the SSD density variation cause.

Alternatively, the conversion table 319-4 can be calculated by using an external measurement unit. The conversion table 319-4 is written on the EEPROM 315 based on measured density at various timings, such as the development of the product, the shipment from the factory, when the service is executed on the apparatus, when the toner CRG is exchanged, and when the image forming apparatus is calibrated.

(C) Description on Banding Correction Processing

Now, banding correction processing executed during image forming will be described. To begin with, banding correction and exposure timings will be described.

Figure 14A:
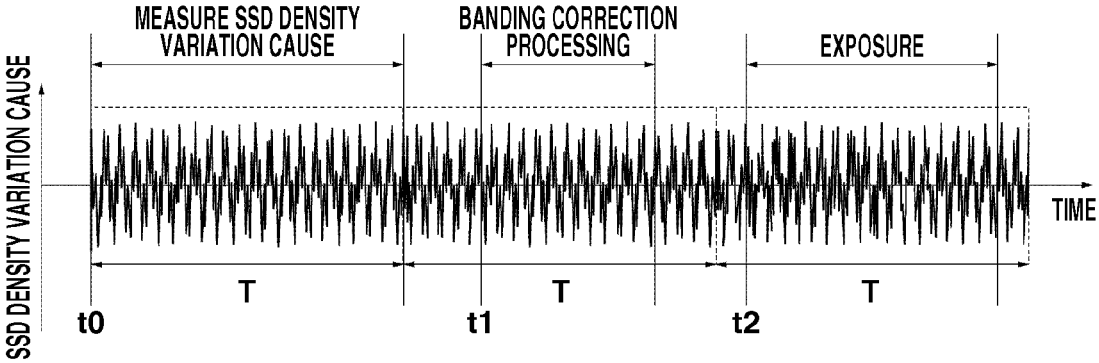
FIG. 14A is a timing chart illustrating a banding correction timing and an exposure timing.

FIG. 14A illustrates an example of a relationship among the measurement of the SSD density variation cause, which is described above with reference to the flow chart of FIG. 11, a timing of start of the banding correction, and a timing of exposure by the scanner unit 24.

Referring to FIG. 14A, the measurement of the SSD density variation cause starts at a timing t0. The banding correction processing starts at a timing t1. The exposure of a page image starts at a timing t2.

More specifically, the exposure start time t2 is determined by the main control unit 321 according to information about the exposure start timing notified from the engine 312. In other words, the main control unit 321 determines the exposure start timing in synchronization with the timing for starting the exposure. The engine 312 notifies the exposure start timing t2 for each page.

Figure 14B:
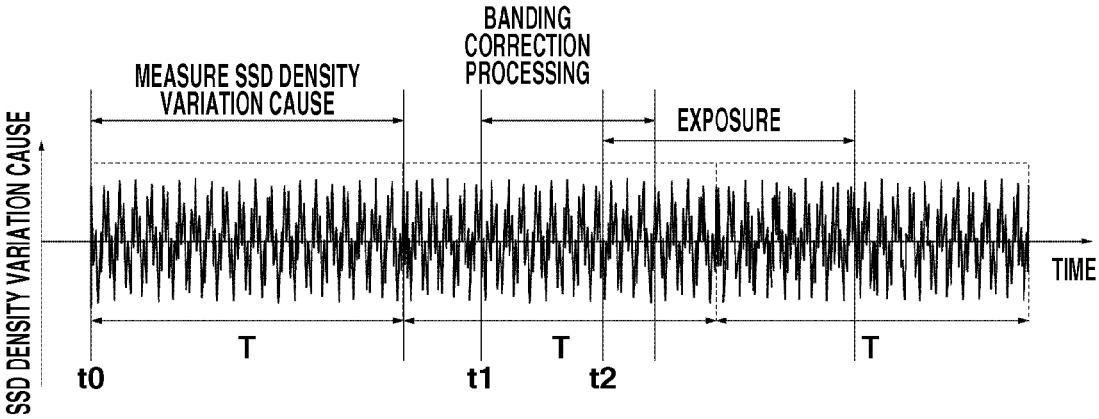
FIG. 14B illustrates an example of phase deviation between a phase of the measured SSD density variation cause and a phase of banding.

In addition, the exposure start timing can be set at any timing after the banding correction processing and the halftone processing on the corresponding image data have been completed. Furthermore, the exposure start timing t2 can be set at an earlier timing. FIG. 14B illustrates an example of such a case.

The banding correction processing is executed by the banding correction unit 307 (FIG. 4) during image forming. Now, the banding correction processing executed by the banding correction unit 307 will be described in detail below with reference to the functional block diagrams and flow charts.

Detailed Description about Functional Blocks of Banding Correction Unit 307

The outline of the exemplary flow of the processing executed by the banding correction unit 307 will be described in detail below with reference to the functional block diagram of FIG. 15.

At first, pulse signals, which are results of the detection by the encoder 45, are input to the calculation unit 46. Then the calculation unit 46 executes the processing according to the flow chart of FIG. 11.

A dot reproductivity analysis unit 3071 executes calculation to acquire dot reproductivity information as information about the image density, by executing the processing according to the flow chart of FIG. 9.

For a conversion table selection unit 3072, a user can select a conversion table to be used from among the plurality of conversion tables illustrated in FIG. 13 according to the input halftone information (the type) and the dot reproductivity information. In the present exemplary embodiment, the conversion table is used. However, other methods or components can be used if the other methods or components can implement the same function as the conversion table.

An SSD density variation cause information calculation unit 3073 (hereinafter simply referred to as the "calculation unit 3073") inputs various information described above, such as the reference time t0, the exposure start time t2, and delay time ΔT. The SSD density variation cause information calculation unit 3073 calculates the SSD density variation cause information pi (pi(t)) at arbitrary time t according to various parameters including the delay time. The delay time ΔT will be described in detail below with reference to FIGS. 14A through 14C.

Figure 14C:
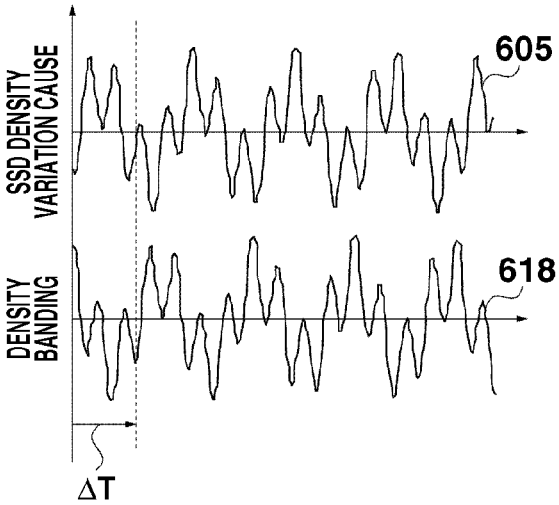
FIG. 14C illustrates an example of delay time, which is a difference of variation in time between the measured SSD density variation cause and the banding.

The delay time denotes the time difference between the generation timing of a point in the wave-form of the SSD density variation cause and the generation timing of a corresponding point thereto in the wave-form of the banding. FIG. 14C illustrates an example of the delay time. Now, a method for calculating the SSD density variation cause 605 (FIG. 14C) and banding 618 (FIG. 14C) will be described.

At first, according to an instruction from the CPU 314, the patch image generation unit 322 generates a halftone image signal of a predetermined density. Then toner images are formed on the intermediate transfer belt 27. In this case, the encoder 45 measures the SSD density variation cause 605 from the timing of start of exposure of the image leading edge. In the present exemplary embodiment, the "image leading edge" does not denote the actual leading edge of the image but denotes a leading edge of the region in which an image can be formed. In addition, the density sensor 41 measures banding from the leading edge of the toner image formed in the above-described manner.

In the present exemplary embodiment, the SSD density variation cause 605 starts from the exposure start timing. On the other hand, the SSD density variation cause 618 starts at the timing of starting the actual detection of toner images by the density sensor 41. In the examples illustrated in FIGS. 14A through 14C, the starting points are aligned for easier reference.

In other words, during the exposure, if the state of the SSD density variation cause can be estimated, the banding corresponding thereto can be identified. Accordingly, the appropriate level of banding correction level can be identified.

More specifically, in the example illustrated in FIG. 14C, the CPU 314 calculates the time difference between the generation timing of a point in the wave-form of the SSD density variation cause and the generation timing of a corresponding point thereto in the wave-form of the banding (i.e., the delay time) ΔT (the phase), and stores the calculated delay time on the RAM 316. In this case, the banding can be corrected according to the SSD density variation cause before ΔT according to the SSD density variation cause that may occur during the exposure.

Figure 15:
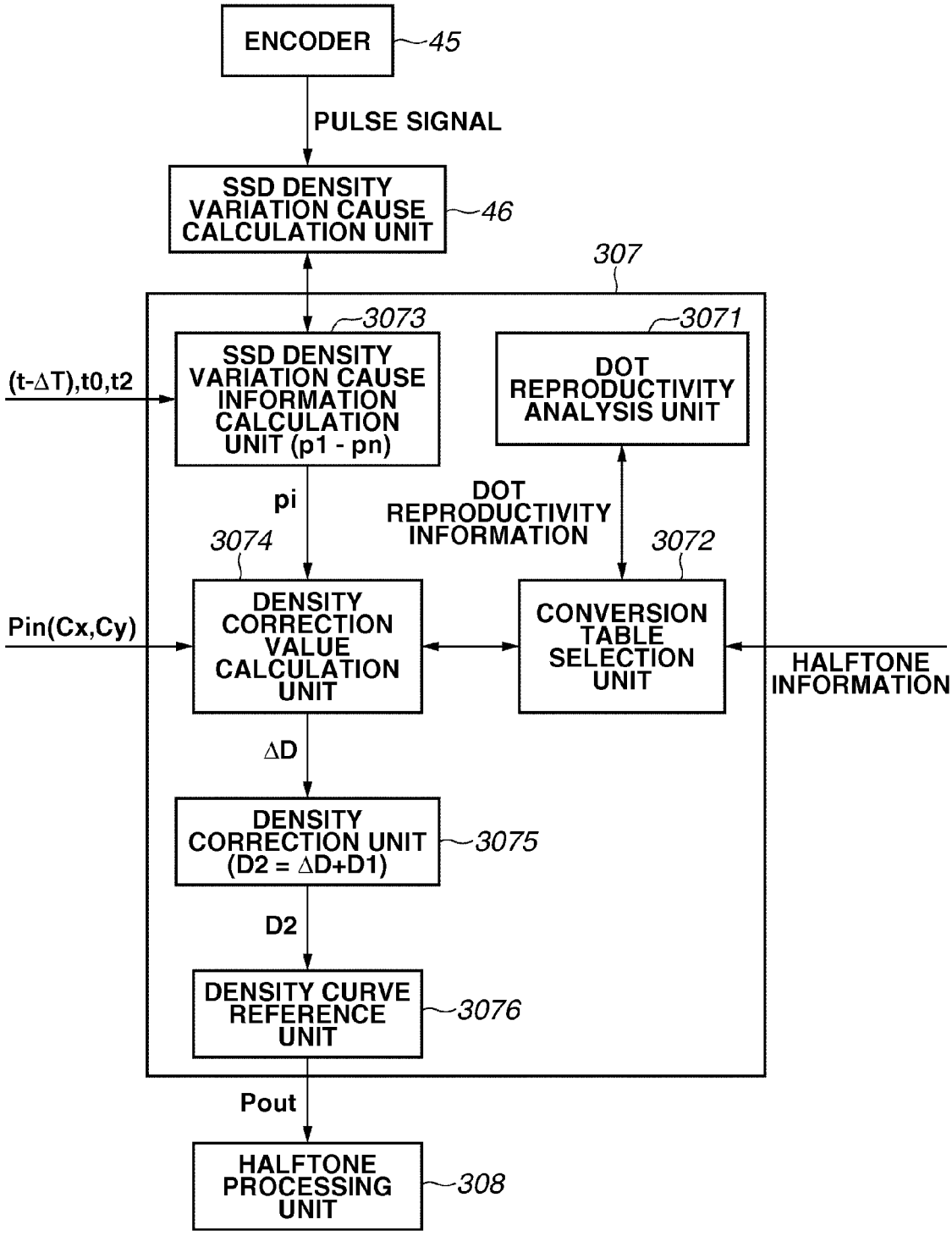
FIG. 15 is a block diagram illustrating an exemplary functional configuration of the image forming apparatus.

Returning to the description with reference to FIG. 15, a density correction value calculation unit 3074 refers to the conversion table that has been selected based on the image signal gradation value Pin to calculate the density correction value ΔD. According to parameters Cx and Cy, the density correction value calculation unit 3074 calculates a density correction value for each pixel.

The density correction unit 3075 calculates a corrected density D2 based on the density of Pin D1 and the calculated ΔD. A density curve reference unit 3076 calculates the gradation value Pout by referring to the density curve. The calculated gradation value Pout is input to the halftone processing unit 308.

(Description about Flow Chart of Processing Executed by Banding Correction Unit 307)

Figure 16A:
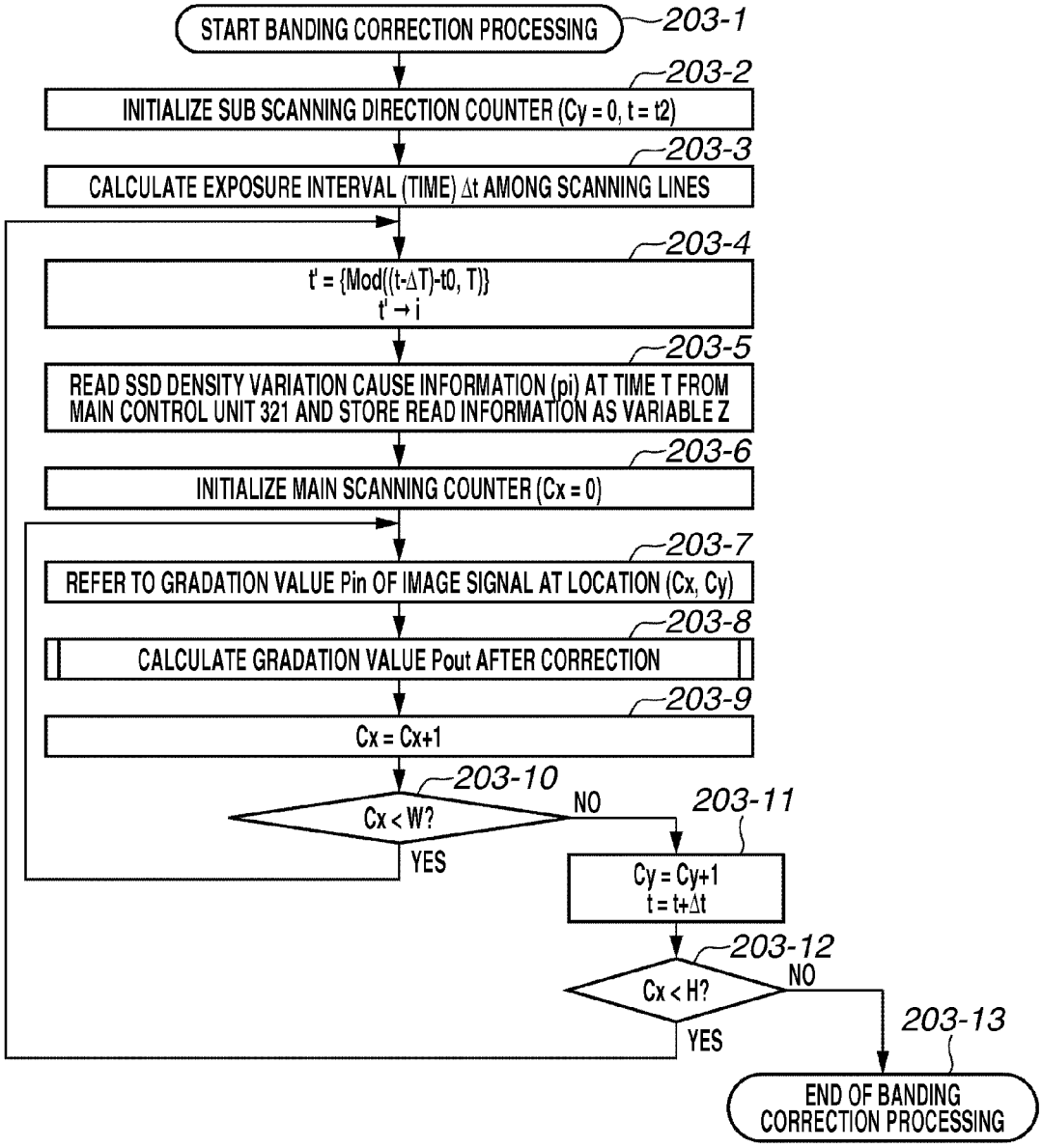
FIGS. 16A and 16B are flow charts illustrating an exemplary flow of banding correction processing.

The processing executed by the banding correction unit 307 according to the present exemplary embodiment will be described in detail below with reference to FIG. 16A.

In step 203-1, the banding correction unit 307 starts the banding correction processing according to an instruction input by the CPU 314. In step 203-2, the banding correction unit 307 initializes a sub scanning counter (Cy) included in the banding correction unit 307 with a value "0". Furthermore, the banding correction unit 307 initializes the time t with the exposure start timing t2 (t=t2). The exposure start timing t2 is as described above.

In step 203-3, the banding correction unit 307 calculates the exposure interval (Δt) between the scanlines. It is supposed that on the EEPROM 315, the rotation speed of the photosensitive drum 22Y (Vd [m/s]) and the target value of the scanline interval are stored (i.e., the scan line intervals et when no SSD density variation cause occurs). In this case, the exposure interval can be calculated by the following expression:

$$\Delta t = \Delta y / Vd.$$

The exposure interval Δt can also be previously stored.

In step 203-4, the banding correction unit 307 identifies a variable i for the SSD density variation cause information pi to be focused at the time t. More specifically, the variable i can be identified by the reference time t0, the exposure start timing at the image leading edge, the delay time ΔT, and the least common multiple period T (=T'/Vd).

Figure 16B:
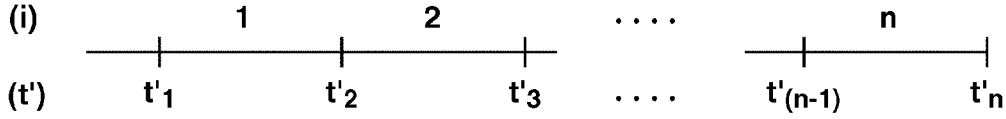

The SSD density variation cause information pi can be calculated by the main control unit 321 in the following manner. That is, the main control unit 321 executes a calculation by using the following expression:

$$t'=\{\mathrm{Mod}((t-\Delta T)-t0,T)\}$$

where "t0" denotes the reference time and "t" denotes arbitrary time. Furthermore, the main control unit 321 converts the calculated time "t'" into the value i of the SSD density variation cause information pi to identify the SSD density variation cause information pi. FIG. 16B illustrates an example of a correspondence table storing the correspondence between and t'. By using the correspondence table illustrated in FIG. 16B, the term t' of the above-described expression can be converted into the term "i" of the SSD density variation cause information pi.

In step 203-5, the banding correction unit 307 acquires the SSD density variation cause information pi at the time t from the RAM 316 of the main control unit 321. Furthermore, the banding correction unit 307 stores the acquired information pi in a variable Z as SSD density variation cause in the sub scanning direction y.

In step 203-6, the banding correction unit 307 initializes the main scanning counter Cx with a value "0". In step 203-7, the banding correction unit 307 receives and refers to the image signal output from the gamma-correction unit 306. In the following description, the gradation value of the image signal is referred to as "Pin".

In step 203-8, the banding correction unit 307, selects and refers to the conversion table to be used from the conversion tables illustrated in FIG. 13B based on the halftone information (type) and the dot reproductivity information. Furthermore, the banding correction unit 307 calculates the gradation value Pout after correction based on the information acquired from the conversion table. The processing in step 203-8 will be described in detail below.

In step 203-9, the banding correction unit 307 increments the main scanning counter Cx by 1. In step 203-10, the banding correction unit 307 compares the main scanning counter Cx with an image width W. If it is determined that the counter Cx is smaller than the image width W (Yes in step 203-10), then the processing proceeds to step 203-7. On the other hand, if it is determined that the counter Cx is equal to or greater than the image width W (No in step 203-10), then the processing proceeds to step 203-11.

The image width W can be defined by the number of dots in the main scanning direction. In addition, an image height H can be defined by the number of scanlines in the sub scanning direction. The image width W and the image height H, which will be described in detail below, are previously detected by the driver 301. Furthermore, the detected information is previously stored on a memory (the RAM 316) (not illustrated) included in the banding correction unit 307.

In step 203-11, the banding correction unit 307 increments the sub scanning counter Cy by 1 and adds Δt to the time t. By executing the above-described addition, the banding correction unit 307 updates the variable i by using the table illustrated in FIG. 16B.

In step 203-12, the banding correction unit 307 compares the image height H and the sub scanning counter Cy. If it is determined that the counter Cx is smaller than the image height H (Yes in step 203-12), then the processing proceeds to step 203-5. On the other hand, if it is determined that the counter Cx is equal to or greater than the image height H (No in step 203-12), then banding correction process ing ends in step 203-13. The banding correction unit 307 executes the processing in each step described above for each of the colors of CMYK.

In the above-described example, it is supposed that the drive motor 47 keeps rotating at a constant speed during time from the start of the SSD density variation cause calculation processing to the timing of start of the image forming. However, the present exemplary embodiment is not limited to this.

Alternatively, for example, the following configuration can be employed. That is, in the SSD density variation cause calculation processing, a home position at the reference time t0 is detected. Furthermore, the rotational distance of the code wheel 44 (i.e., the number of pulses of the encoder output signal 48) measured up to the timing of starting the image forming. In this case, the relationship between the variable i and the time t' described above with reference to FIG. 16B can be substituted with the correlation between the variable i and the frequency of the code wheel 44 (the number of pulses) to identify the SSD density variation cause information pi.

As described above, if the distance is used as the parameter, the present exemplary embodiment can identify the phase (pi) of the SSD density variation cause at the start of and during the image forming.

(Description about Gradation Value Calculation Processing (Step 203-8))

Now, the gradation value interpolation calculation processing executed in step 203-8 illustrated in FIG. 16A will be described in detail below with reference to FIG. 17.

In step 204-1, the gradation value calculation processing starts. In step 204-2, the banding correction unit 307 searches the density correction information 319 on the RAM 316 for a gradation value 319-3 closest to Pin in the negative direction, and stores an extracted gradation value as the variable P1. In the present exemplary embodiment, the "negative direction" is a direction in which the gradation value becomes smaller.

In step 204-3, the banding correction unit 307 refers to the conversion table 319-4 for the gradation value stored in the variable P1, the table 319-4 being calculated by step 204-2. Furthermore, the banding correction unit 307 calculates the density correction value that may occur due to the SSD density variation cause Z. Furthermore, the banding correction unit 307 stores the calculated density correction value in a variable ΔD1.

In step 204-4, the banding correction unit 307 compares the gradation value Pin with the phase P1. If it is determined that the gradation value Pin is not the same as the phase P1 (Yes in step 204-4), then the processing proceeds to step 204-5. On the other hand, if it is determined that the gradation value Pin is the same as the phase P1 (No in step 204-4), then the processing proceeds to step 204-11 because the variable ΔD1 itself is used as the correction value because the gradation value Pin and the phase P1 are the same. In step 204-11, the banding correction unit 307 substitutes ΔD, which is a variable and denotes the density correction value, with ΔD1. Then the processing proceeds to step 204-8.

In step 204-5, the banding correction unit 307 searches for a gradation value whose gradation value 319-3 is the closest to Pin in the positive direction from the density correction information 319 on the RAM 316, and stores the extracted gradation value in a variable P2.

In step 204-6, the banding correction unit 307 refers to the conversion table 319-4 included in the density correction information 319 calculated in step 204-5. Furthermore, the banding correction unit 307 calculates the density correction value corresponding to the SSD density variation cause Z, and stores the calculated value in the variable ΔD2.

In step 204-7, the banding correction unit 307 executes interpolation to calculate the density correction value ΔD by executing the following expression:

$$\Delta D=\Delta D'(P\text{in}-P1)+\Delta D1$$

where ΔD'=(ΔD2−ΔD1)/(P2−P1).

In step 204-8, the banding correction unit 307 refers to a density curve 610 to calculate the density D1 corresponding to the gradation value Pin. Density curves 602 and 615 are density curves similar to the density curve 610. In step 204-9, the banding correction unit 307 calculates the density D2 after the banding is corrected by an expression "D2=(D1+ΔD)".

In step 204-10, the banding correction unit 307 refers to the density curve 610, calculates the gradation value at the density D2 (the gradation value Pout after the banding is corrected), and the gradation value interpolation calculation processing ends in step 204-12.

Figure 17:
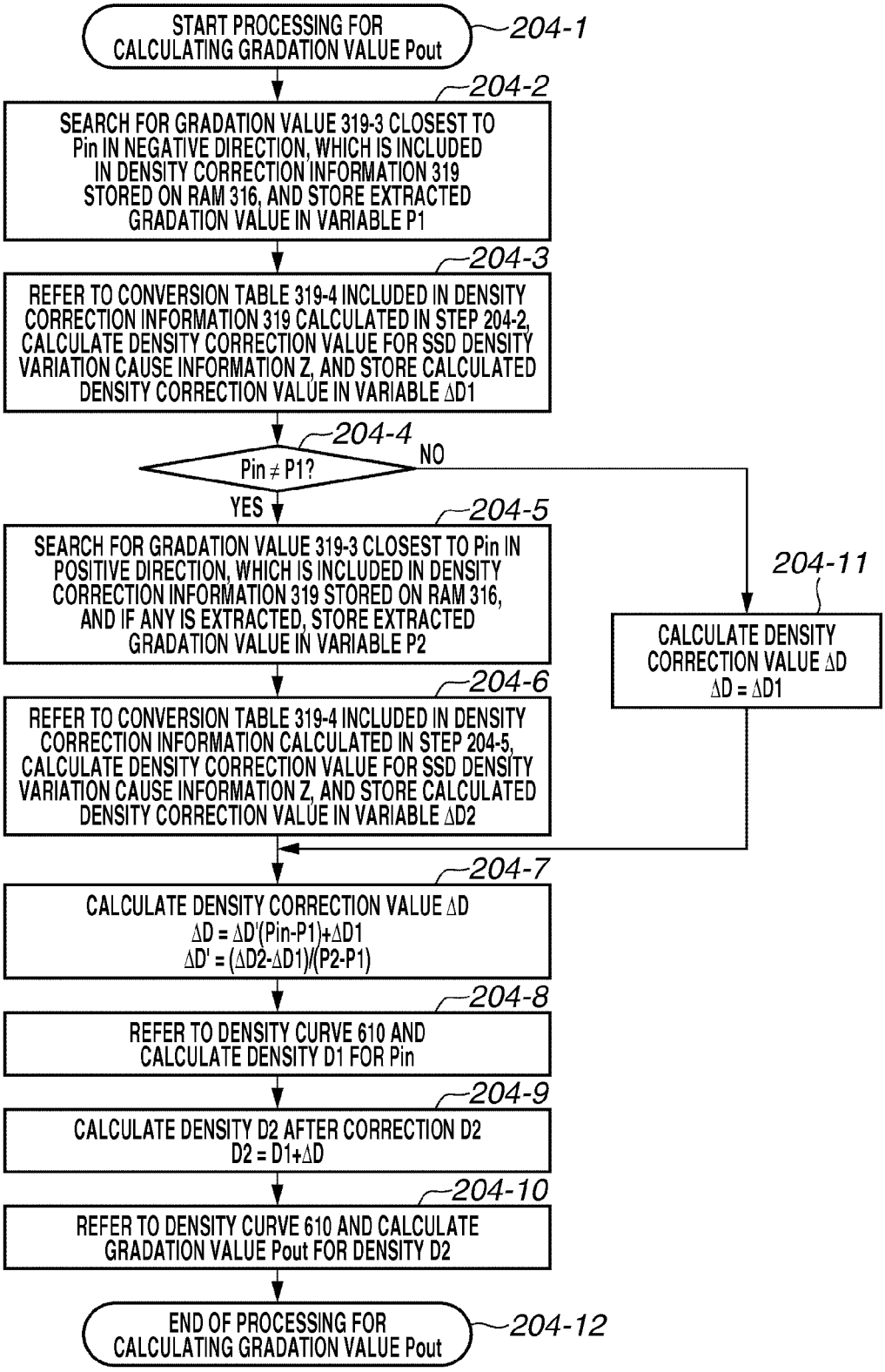
FIG. 17 is a flow chart illustrating an exemplary flow of gradation value calculation processing executed during the banding correction processing.

Now, an exemplary relationship among the variables described above with reference to FIG. 17 will be described in detail below with reference to FIGS. 18A and 18B. More specifically, FIGS. 18A and 18B illustrates an example of a relationship among the variables and the table utilized in the gradation value interpolation calculation processing described above with reference to FIG. 17.

Figure 18A:
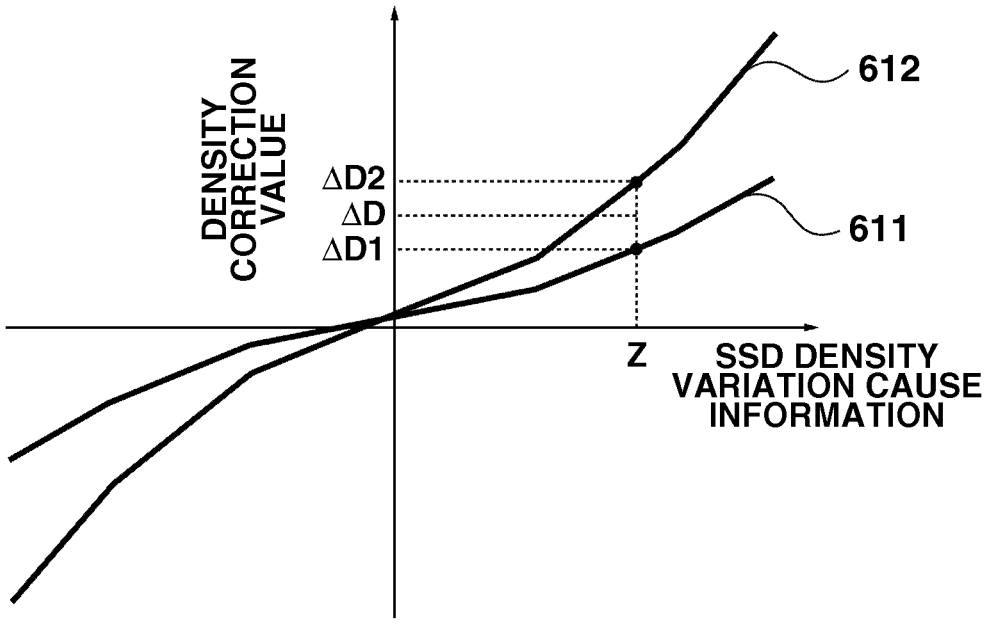
FIGS. 18A and 18B illustrate an exemplary method for calculating a gradation value, which is executed during the banding correction processing according to a first exemplary embodiment and a second exemplary embodiment of the present invention, respectively.
Figure 18B:
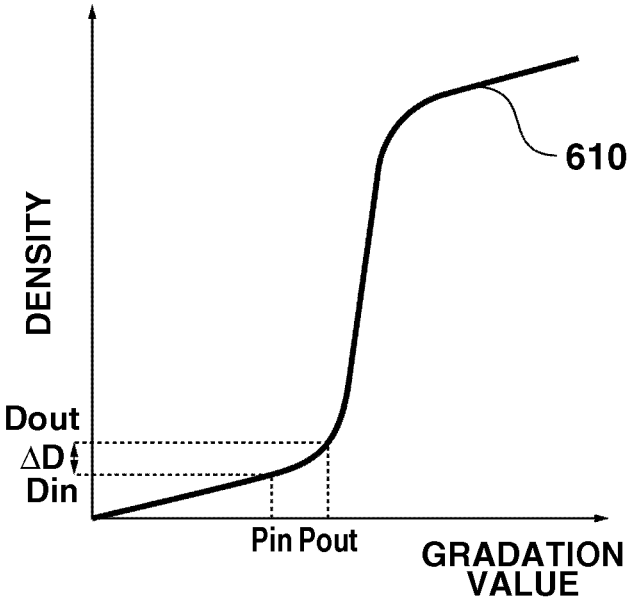

Referring to FIG. 18A, a curve 611 denotes the conversion table 319-4 at the gradation value P1, which has been selected in step 204-2. In the example illustrated in FIG. 18A, another curve 612 denotes the conversion table 319-4 at the gradation value P2, which has been selected in step 204-5. In FIG. 18A, "Z", "ΔD1", and "ΔD2" correspond to the SSD density variation cause Z, the density correction value ΔD1, and the density correction value ΔD2 illustrated in FIG. 17, respectively.

In the example illustrated in FIG. 18A, the density correction value ΔD can be calculated, if Pin=(P1+P2)/2, by executing the interpolation calculation executed in step 204-7 illustrated in FIG. 17. FIG. 18B illustrates an exemplary relationship among the density curve 610 and the gradation values Pin and Pout, the density correction value ΔD, the density Pin, and the density Pout illustrated in FIG. 17.

In the example described above, the processing for a specific color (yellow (Y)) is described. However, actually, the present exemplary embodiment executes the same processing for all the colors of CMYK. In addition, in the present exemplary embodiment, it is supposed that the SSD density variation cause having two periods T1 and T2 has occurred. However, the period to be focused is not limited to the above-described periods.

In other words, instead of the periods T1 and T2, a plurality of other periods or one period different from the periods T1 and T2 can be used. By determining the period to be focused based also on the visual characteristic of the eyes of the user, the above-described exemplary embodiment can be effectively implemented by executing the correction primarily at the frequency at which the user may becomes visually sensitive. In addition, the above-described exemplary embodiment of the present invention can be implemented by focusing on the SSD density variation cause only which has the amplitude of variation higher than a predetermined level.

In addition, in the present exemplary embodiment, two dot reproduction states are used. However, in actual cases, three or more states can be defined and processed in the similar manner as described above. In addition, in the present exemplary embodiment, the mean distance between the reference data and the measured data is utilized as one method for calculating the degree of similarity between the gamma-correction tables. However, any other appropriate methods different from the method for calculating the degree of similarity between the gamma-correction tables can be used. More specifically, the similarity degree can be calculated by weighting the distances in calculating the mean distance for each gradation level. Alternatively, the slope of the table can be calculated and used as the basis of calculating the degree of similarity between the gamma-correction tables. Further alternatively, an arbitrary characteristic amount of the tables can be calculated and used as the basis of calculating the degree of similarity between the gamma-correction tables.

As described above, in the present exemplary embodiment, eight conversion tables are provided to each gradation. However, a greater or a smaller number of conversion tables can be used. In addition, in the present exemplary embodiment, the conversion table is generated in the unit of two halftones. However, the present exemplary embodiment is not limited to this.

In addition, in the present exemplary embodiment, the previously stored conversion table stores all information whose number of patterns is equivalent to the number calculated by "(the number of the dot reproductivity states)×(the number of the gradations)×(the number of the halftones). However, the present exemplary embodiment is not limited to this. More specifically, if the conversion table is a conversion table corresponding to the halftone whose banding is not so visible (i.e., a low resolution halftone), then other conditions (the number of dot reproduction states and the number of the gradations) can be reduced. Further alternatively, the banding correction can be executed on a specific halftone.

According to the present exemplary embodiment having the above-described configuration, if the density variation whose corresponding curve has the shape similar to the shape of the curve corresponding to the SSD density variation cause can be subjected to banding correction according to the specific current state without taking the trouble of forming dedicated patches. In addition, the toner consumption amount can be effectively reduced.

In addition, even if the above-described density variation is minute, the above-described banding correction can be executed with a high accuracy based on a result of previously measuring the density variation by using an external measurement device and according to the conversion table that has been previously generated in the above-described manner. Furthermore, it becomes unnecessary to particularly provide the image forming apparatus body with a density sensor dedicated to detect the density with a high accuracy, such as the external measurement device.

Furthermore, if a computer and a scanner are externally and separately provided, which are provided to analyze the state of banding occurring on an actually printed image and to return the analysis result to the image forming apparatus, the convenience of the user may be low. On the contrary, according to the present exemplary embodiment having the above-described configuration, it is not required to separately provide the additional external computer or scanner. Accordingly, the present exemplary embodiment can implement appropriate banding correction. Therefore, the present exemplary embodiment can increase the usability of the apparatus.

Now, a second exemplary embodiment of the present invention will be described in detail below. In the above-described first exemplary embodiment, in executing the dot reproductivity information acquisition processing, the dot reproductivity is calculated by utilizing the similarity of the shapes of the measured gamma-correction table and the reference gamma-correction table calculated by executing Dhalf control.

In the present exemplary embodiment, the dot reproductivity is calculated based on the direct current-like density of predetermined simple patch images constituted by minute dots formed on the intermediate transfer belt 27. In the following description, the direct current-like density will be simply referred to as a "DC density". To paraphrase this, in the present exemplary embodiment, density information about simple patch images is used as the indirect density variation information, which indirectly indicates the level of the density variation.

The DC density does not include alternate-current-like density variation, which may occur due to the SSD density variation cause after the inverse Fourier transform illustrated in FIG. 14C or acquired by executing step 202-8. In the present exemplary embodiment, the configuration of the printing unit of the image forming apparatus and processing except the dot reproductivity information acquisition processing are similar to those of the above-described first exemplary embodiment. Accordingly, the detailed description thereof will not be repeated here.

<Dot Reproductivity Information Acquisition Processing>

Now, the dot reproductivity information acquisition processing according to the present exemplary embodiment will be described in detail below with reference to FIG. 19. To be brief, during the dot reproductivity information acquisition processing, the present exemplary embodiment selects the dot reproductivity set to the density that is the closest to the DC density of detected patch images, among previously set density levels.

(Description about Density Patch Detection Processing)

A method for forming a density patch and for detecting the density thereof will be described. At first, the engine 312 sets a predetermined value as a value of the development bias. Furthermore, the gamma-correction unit 306 and the halftone processing unit 308 execute image processing on an input image signal 613 illustrated in FIG. 19. Furthermore, the PWM processing unit 309 executes pulse width modulation on the image-processed image signal. Furthermore, the PWM processing unit 309 outputs the resulting data to the laser drive unit 310.

The laser drive unit 310 drives the scanner unit 24 according to the input data. Furthermore, the laser drive unit 310 forms electrostatic latent images on the photosensitive drum 22. Moreover, the generated images are subjected to the electrophotographic process described above with reference to FIG. 1 to form patch images on the intermediate transfer belt 27. In outputting the patch image, a throughput gamma-correction table 601 (FIG. 6B) is used.

An image signal 317, which has not been subjected to processing by the banding correction unit 307 yet, is input to the halftone processing unit 308 by a signal switching unit (not illustrated). The density of the patch image formed on the intermediate transfer belt 27 can be detected by the density sensor 41.

Figure 19:
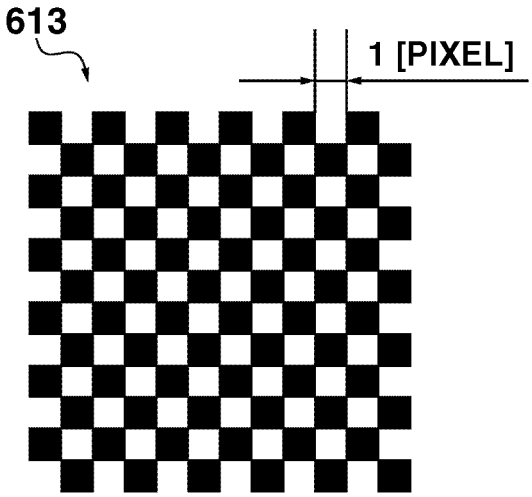
FIG. 19 illustrates an example of a patch image according to the second exemplary embodiment of the present invention.
Figure 21A:
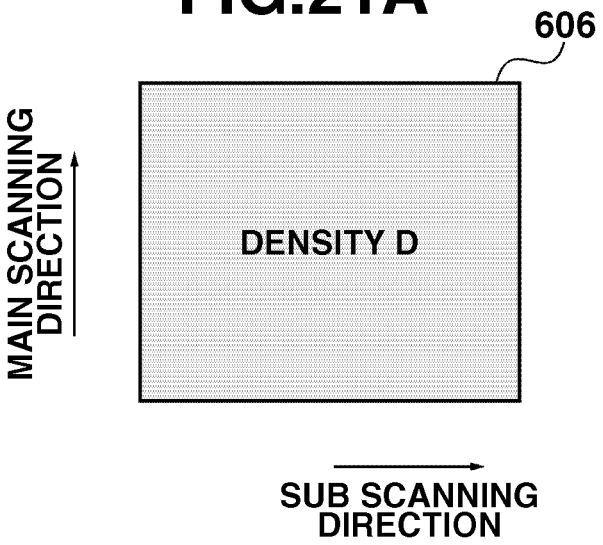
FIGS. 21A and 21B illustrate an amplitude of banding that may occur when a conventional method is used, and that may occur due to an SSD density variation cause.
Figure 21B:
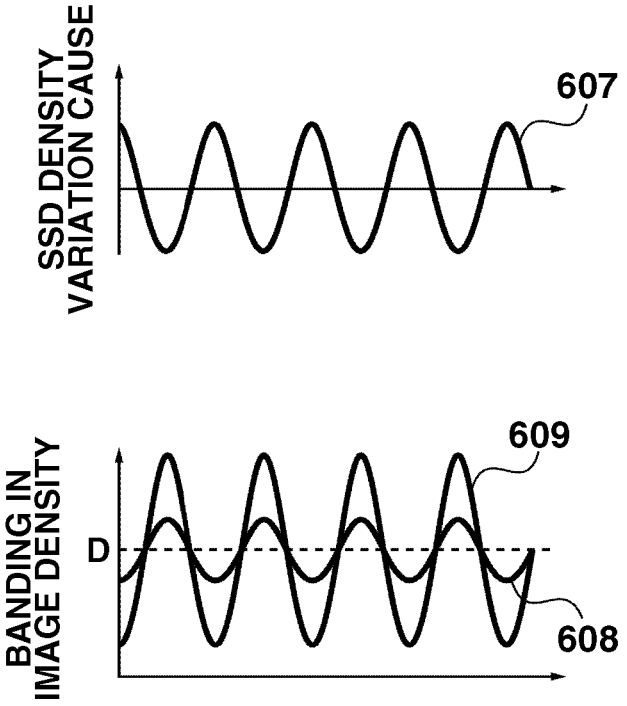

The density patch 613 illustrated in FIG. 19 is a mere example. For the patch image, it is desirable to selectively utilize an image whose density can easily vary due to the operation environment of (the temperature and the humidity inside or around) the image forming apparatus and the consumption or deterioration of the image forming apparatus body or the cartridge (i.e., an image including a large number of minute dots).

(Density Information at Each Dot Reproductivity)

Now, density information at each dot reproductivity will be described in detail. FIG. 20 illustrates the density of 613, which has been measured in the density patch detection processing described above at three dot reproductivity states (the state 1, the state 2, and the state 3). The information illustrated in FIG. 20 is previously stored on the EEPROM 315 and is utilized to be referred to during the dot reproductivity information acquisition processing described below.

(Flow of Dot Reproductivity Information Acquisition Processing)

Now, an exemplary flow of dot reproductivity information acquisition processing will be described in detail below. At first, the patch image 613 is measured by executing the above-described density patch detection processing. Then, the present exemplary embodiment selects the dot reproductivity whose density variation is the closest to the reference information among the reference information stored on the EEPROM 315 (FIG. 20). Furthermore, the present exemplary embodiment stores a result of the selection on the RAM 316 as dot reproductivity information. For example, if reference information d2 is reference information that is the closest to the measured density, then the dot reproductivity information is the "state 2".

In the present exemplary embodiment, the description of the type of the halftone is omitted in relation to the processing for selecting the conversion table. However, as in the first exemplary embodiment, in selecting the conversion table, the present exemplary embodiment uses the type of the halftone as well as the dot reproductivity information as the basis of the selection of the conversion table.

(Timing of Executing Dot Reproductivity Information Acquisition Processing)

The image forming apparatus according to the present exemplary embodiment executes the dot reproductivity information acquisition processing when the engine is powered on and when a predetermined number of sheets is printed.

Now, a third exemplary embodiment of the present invention will be described in detail below. In the above-described first exemplary embodiment, the dot reproductivity information is acquired (estimated) according to a result of determining to the shape of which type reference gamma-correction table the shape of the currently stored gamma-correction table is similar by executing the processing in the flow chart of FIG. 9. Furthermore, in the first exemplary embodiment, the level of the banding correction value corresponding to the SSD density variation cause is determined according to the information acquired by referring to the conversion table generated based on the acquired dot reproductivity information.

In the above-described second exemplary embodiment, the dot reproductivity information is acquired according to the detected density of the simple patch illustrated in FIG. 19. In the present exemplary embodiment, the acquisition of the dot reproductivity information is implemented by a method different from that in the first exemplary embodiment or the second exemplary embodiment.

In the present exemplary embodiment, instead of detecting a patch image as the second exemplary embodiment, the conversion table is estimated according to the operation environment of (the temperature and the humidity inside or around) the image forming apparatus and the consumption or deterioration of the image forming apparatus body or the cartridge.

More specifically, in the present exemplary embodiment, the main control unit 321 (the CPU 314) first detects the operation environment of (the temperature and the humidity inside or around) the image forming apparatus by using an environment sensor (not illustrated) to acquire information about the operation environment, which is a detection result.

In addition, the main control unit 321 (the CPU 314) acquires information about the image forming apparatus body or the cartridge, such as the number of printed sheets, the operation time, the power supply time, or the frequency of the photosensitive drum 22, as operation state information that denotes the level of consumption or deterioration of the image forming apparatus body or the cartridge.

Furthermore, the main control unit 321 executes prediction calculation of the DC density detected by the density sensor if the patch illustrated in FIG. 19 is formed based on the acquired operation environment information and the information about the consumption or the deterioration state information.

After predicting the density, the present exemplary embodiment selects appropriate dot reproductivity information based on the density calculated by the prediction operation and the reference information illustrated in FIG. 20. Moreover, in the present exemplary embodiment, the image forming apparatus, after completing the above-described characteristic processing, executes the processing similar to the processing executed by the first exemplary embodiment. However, the description about the processing similar to the first exemplary embodiment will not be repeated here.

As in the second exemplary embodiment, in the present exemplary embodiment also, the description of the type of the halftone in the selection of the conversion table is omitted. However, as in the first exemplary embodiment, in selecting the conversion table, the present exemplary embodiment uses the type of the halftone as well as the dot reproductivity information as the basis of the selection of the conversion table.

Now, a fourth exemplary embodiment of the present invention will be described in detail below. In each exemplary embodiment of the present invention described above, the intermediate transfer belt 27 is used as the image carrier carrying the toner image. In addition, the photosensitive drum 22 is used as the rotation member for forming the toner image on the image carrier or on the transfer material. However, the present invention is not limited to this.

More specifically, if the intermediate transfer belt 27 is used as the image carrier for carrying the toner image, the development roller 23, which supplies the developer to the photosensitive drum 22, or the belt drive roller 40, which rotationally drives the endless belt, can be used as the rotation member. In addition, a motor for rotationally driving the photosensitive drum 22, a motor for rotationally driving the development roller 23, or a motor for rotating the belt drive roller 40 can be used as the rotation member. Furthermore, another rotational member for forming the toner image can be used.

If the photosensitive drum 22 is used as the image carrier for carrying the toner image, a motor for rotationally driving the photosensitive drum or a motor for rotationally driving the development roller, which supplies the developer to the photosensitive drum 22, can be used as the rotation member.

The present invention can also be achieved by providing a system or an apparatus with a storage medium storing program code of software implementing the functions of the embodiments and by reading and executing the program code stored in the storage medium with a computer of the system or the apparatus (a CPU or a micro processing unit (MPU)).

Furthermore, the above-described functions, such as the conversion table, gamma-correction table, or reference gamma-correction table are not limited to the format of a table. More specifically, a calculation unit capable of implementing similar functions can be used instead.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-082808 filed Mar. 31, 2010, which is hereby incorporated by reference herein in its entirety.

What is claimed is:

1. An image forming apparatus comprising:

a rotation member configured to form a toner image on an image carrier based on image information;

a first acquisition unit configured to acquire density variation cause information about a cause of density variation occurring in a sub scanning direction of an image, which may occur due to rotation of the rotation member;

a correction unit configured to correct the image information according to the information about the cause of the density variation acquired by the first acquisition unit; and a second acquisition unit configured to acquire indirect density variation information, which indirectly indicates a level of the density variation, wherein the correction unit is configured to set a level of correcting the image information corresponding to the density variation cause information based on the indirect density variation information without detecting, from the formed toner image, a level of the density variation corresponding to the density variation cause information.

2. The image forming apparatus according to claim 1, wherein the indirect density variation information does not have a characteristic according to a frequency characteristic of variation of the cause of the density variation.

3. The image forming apparatus according to claim 1, wherein the correction unit includes an interpolation unit configured to interpolate the level of the correction on the image information at a gradation value of the input image information based on a relationship between a plurality of predetermined gradation values of the image information and the density variation cause information.

4. The image forming apparatus according to claim 1, wherein the indirect density variation information is information stored in a density correction table for correcting a density of an input image.

5. The image forming apparatus according to claim 4, further comprising:

a patch formation instruction unit configured to cause the rotation member to rotate to form a patch on the image carrier;

a detection unit configured to detect reflection light from the patch by irradiating the patch formed on the image carrier with light; and a setting unit configured to set the density correction table based on a result of the detection by the detection unit.

6. The image forming apparatus according to claim 1, wherein the indirect density variation information is direct current-like density information.

7. The image forming apparatus according to claim 1, wherein the indirect density variation information is information about an operation environment of the image forming apparatus or information about an operation state of the image forming apparatus.

8. The image forming apparatus according to claim 1, wherein the indirect density variation information is information indicating a type of an image processing method to be executed.

9. The image forming apparatus according to claim 1, wherein the image carrier is a belt configured to carry the toner image, and wherein the rotation member is a photosensitive drum configured to form the toner image to be transferred onto the image carrier, a development roller configured to supply a developer to the photosensitive drum, a belt drive roller configured to rotationally drive the belt, a motor configured to rotationally drive the photosensitive drum, a motor configured to rotationally drive the development roller, or a motor configured to rotationally drive the belt drive roller.

10. The image forming apparatus according to claim 1, wherein the image carrier is a photosensitive drum, and wherein the rotation member is a motor configured to rotationally drive the photosensitive drum or a motor configured to rotationally drive the development roller configured to supply a developer to the photosensitive drum.

11. An image forming apparatus comprising:

a rotation member configured to form a toner image on a recording sheet based on image information;

a first acquisition unit configured to acquire density variation cause information about a cause of density variation occurring in a sub scanning direction of an image, which may occur due to rotation of the rotation member;

a correction unit configured to correct the image information according to the information about the cause of the density variation acquired by the first acquisition unit; and a second acquisition unit configured to acquire indirect density variation information, which indirectly indicates a level of the density variation, wherein the correction unit is configured to set a level of correcting the image information corresponding to the density variation cause information based on the indirect density variation information without detecting, from the formed toner image, a level of the density variation corresponding to the density variation cause information.

12. An image forming apparatus comprising:

a rotation member configured to form a toner image on an image carrier based on image information;

a first acquisition unit configured to acquire density variation cause information about a cause of density variation occurring in a sub scanning direction of an image, which may occur due to rotation of the rotation member;

a second acquisition unit configured to acquire indirect density variation information, which indirectly indicates a level of the density variation; and a correction unit configured to correct the image information based on correction information according to factor information of the density variation obtained by the first acquisition unit and the indirect density variation information obtained by the second acquisition unit.

13. An image forming apparatus comprising:

a rotation member configured to form a toner image on a recording sheet based on image information;

a first acquisition unit configured to acquire density variation cause information about a cause of density variation occurring in a sub scanning direction of an image, which may occur due to rotation of the rotation member;

a second acquisition unit configured to acquire indirect density variation information, which indirectly indicates a level of the density variation; and a correction unit configured to correct the image information based on correction information according to factor information of the density variation obtained by the first acquisition unit and the indirect density variation information obtained by the second acquisition unit.

* * * * *